US007976344B2

(12) United States Patent
Brunker et al.

(10) Patent No.: US 7,976,344 B2
(45) **Date of Patent: *Jul. 12, 2011**

(54) CO-EDGE CONNECTOR

(75) Inventors: David L. Brunker, Naperville, IL (US); Timothy R. Gregori, Lockport, IL (US); David E. Dunham, Aurora, IL (US); Jason E. Squire, Batavia, IL (US); Kevin O'Connor, Lisle, IL (US); Joseph D. Comerci, Elmhurst, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/942,638

(22) Filed: Nov. 9, 2010

(65) Prior Publication Data

US 2011/0053425 A1 Mar. 3, 2011

Related U.S. Application Data

(63) Continuation of application No. 12/328,577, filed on Dec. 4, 2008, now Pat. No. 7,845,985.

(60) Provisional application No. 61/068,019, filed on Mar. 4, 2008.

(51) Int. Cl.
*H01R 24/00* (2006.01)

(52) U.S. Cl. ..... 439/631

(58) Field of Classification Search ..... 439/676, 439/941, 620.11, 620.17, 620.23
See application file for complete search history.

(56) References Cited

U.S. PATENT DOCUMENTS

| | | | |
|---|---|---|---|
| 3,740,698 | A | 6/1973 | Jerominek |
| 4,114,976 | A | 9/1978 | Selvin et al. |
| 4,575,175 | A | 3/1986 | Wilson |
| 4,660,920 | A | 4/1987 | Shibano |
| 4,983,132 | A | 1/1991 | Weidler |
| 5,277,621 | A | 1/1994 | Seto |
| 5,531,615 | A | 7/1996 | Irlbeck et al. |
| 5,926,378 | A | 7/1999 | DeWitt et al. |
| 5,928,036 | A | 7/1999 | Thrush |
| 6,024,608 | A | 2/2000 | Azuma et al. |
| 6,109,927 | A | 8/2000 | Scholz et al. |
| 6,129,561 | A | 10/2000 | Lok |
| 6,406,332 | B1 | 6/2002 | Buican et al. |
| 6,431,876 | B1 | 8/2002 | Svenkeson et al. |
| 6,508,664 | B2 | 1/2003 | Phalen |
| 6,666,695 | B1 | 12/2003 | Yeh |
| 6,666,696 | B1 | 12/2003 | Wu |

(Continued)

OTHER PUBLICATIONS

International Search Report for PCT/US2009/35827.

*Primary Examiner* — T C Patel
*Assistant Examiner* — Phuong T Nguyen
(74) *Attorney, Agent, or Firm* — Stephen L. Sheldon

(57) ABSTRACT

A connector includes a housing with a set of broad-side coupled terminals configured to engage a pair of signal traces on a first panel and a second panel and transfer signals between the signal traces on the first and second panels. The connector may be slid onto the edges and then fastened to one or both of the panels with a locking feature. Multiple signal pairs may be included in the connector and may be electrically separated. The design of the connector helps facilitate high-speed data communication per signal pair with a return loss performance that does not exceed at predetermined level. Certain configurations of the connector may be used for co-planar configurations. Certain configurations of the connector may couple together panels of different thicknesses.

12 Claims, 27 Drawing Sheets

U.S. PATENT DOCUMENTS 7,160,141 B2 1/2007 Marshall et al.
7,547,214 B2 * 6/2009 Duesterhoeft et al. ..... 439/61
7,845,985 B2 * 12/2010 Brunker et al. ..... 439/631
2002/0132529 A1 9/2002 Tharp et al.
2008/0293262 A1 * 11/2008 Duesterhoeft et al. ..... 439/65

* cited by examiner

FIG.19b
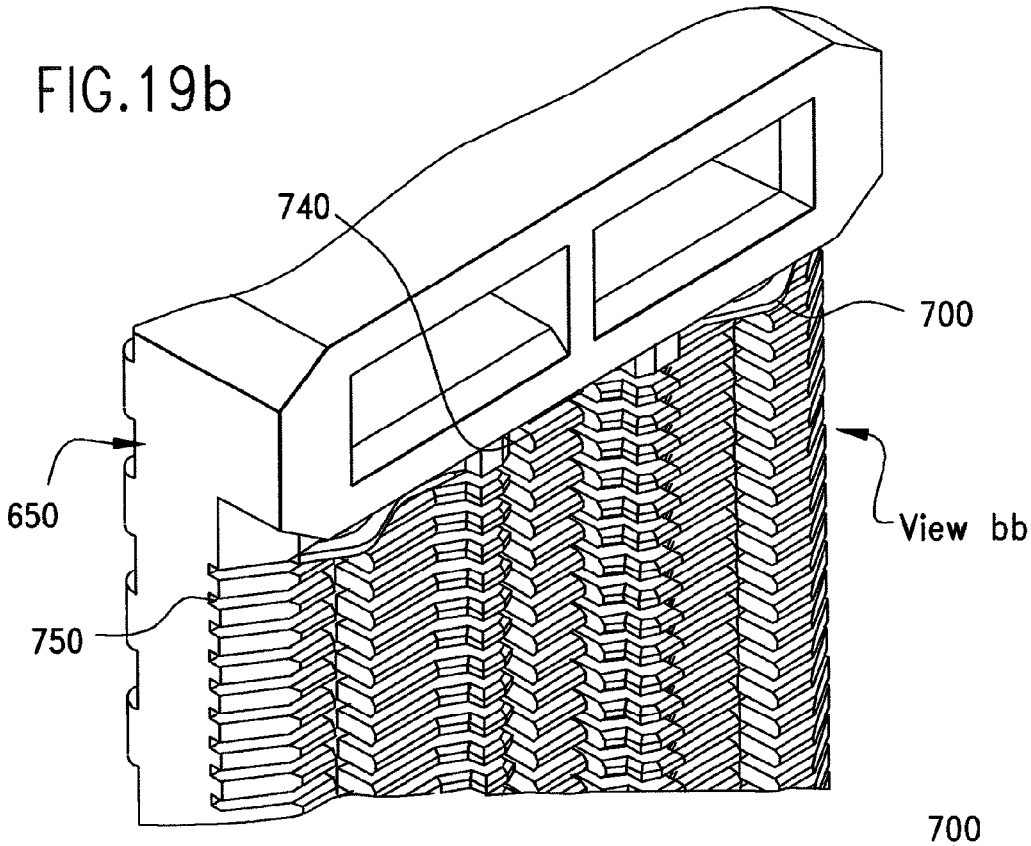
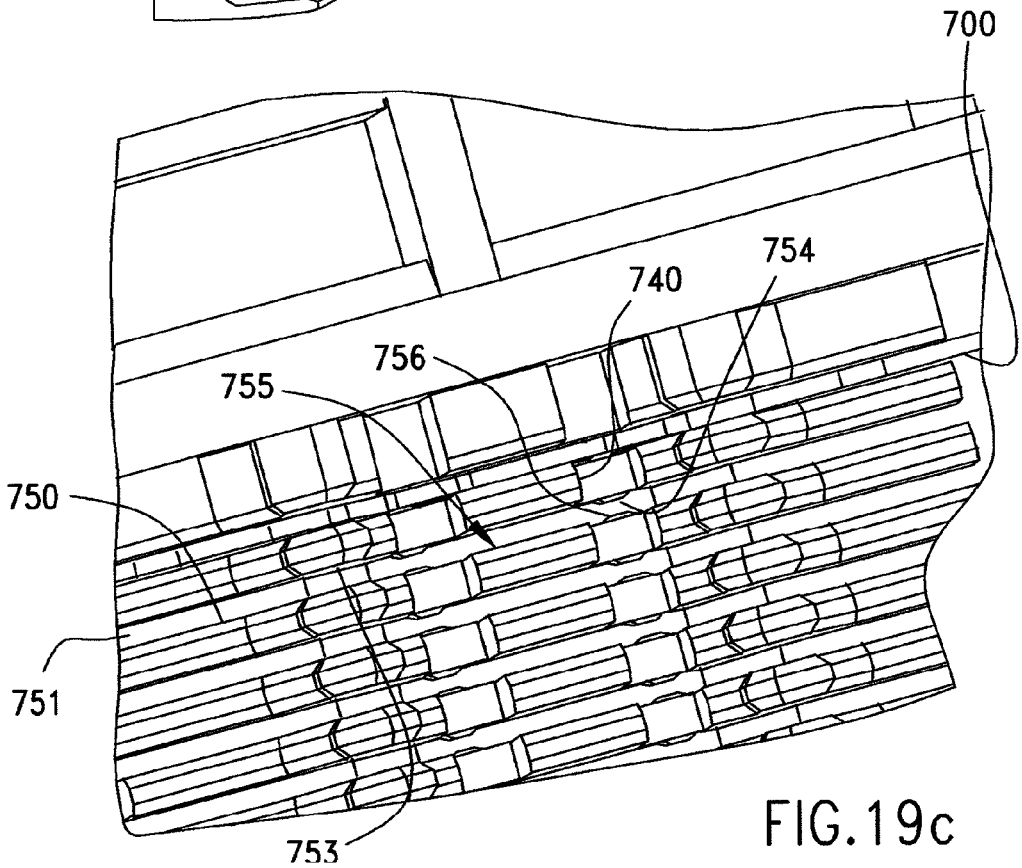
FIG.19c

CO-EDGE CONNECTOR

RELATED APPLICATIONS

This application is a continuation of U.S. application Ser. No. 12/328,577, filed Dec. 4, 2008, now U.S. Pat. No. 7,845,985, which in turn claims priority to Provisional Application Ser. No. 61/068,019, filed Mar. 4, 2008, both of which are incorporated herein by reference in their entirety.

BACKGROUND

1. Field of the Invention

The present invention generally relates to connectors useful for transferring signals from traces adjacent an edge of a first panel to traces adjacent an edge of a second panel.

2. Description of Related Art

A panel, such as printed circuit board (PCB), is commonly used to support components and facilitate transfer of signals between the components installed on the panel. For example, a processing unit, such as a central processing unit (CPU) can be installed on a motherboard (an example of a PCB) and the CPU may be used as the processing brains of a computer, such as a server, and may be coupled to memory modules, communication modules and the like. Thus, while a CPU tends to be a common processing component, it is also relatively common to combine multiple components, including multiple processors, on a single panel and have the components communication with each other. Other types of component modules, such as memory modules, communication modules and the like may also be placed on the panel and brought into communication with each other. Depending on the application, the component modules on the panel can be designed to address a wide range of needs by combining different types of components together in an appropriate architectural configuration.

Because of the relatively rapid rate of technology improvements, however, it is often beneficial to include a design that is capable of being upgraded. In addition, it is often beneficial to provide a customer the ability to customize the components in communication with each other. Therefore, connectors (sometimes referred to as adaptors) are sometimes included on the panel so that additional components can be coupled to the panel based on customer requirements. Often the connector will connect signal traces on one panel with signal traces on another panel so that components coupled to the signal traces on the two panels can communicate together. The use of connectors allow for a base panel design that can be modified based on customer requirements. In practice, a connector can allow a first panel with a first set of components to be mated to a second panel with a second set of components. In the computer world, for example, a personal computer (PC) might include one or more processors on a first panel (e.g., a motherboard). The first panel could support a number of connectors, some designed to accept panels with memory modules and other connectors designed to accept panels that supported additional processors. Therefore, a customer could decide how much performance was desired and select and install the appropriate panel(s) (with the desired components) in the connector(s). This methodology can be used with a large variety of components, basically for any type of component that would provide a benefit if brought into communication with the existing components.

One solution for providing the desired flexibility is to mount a connector on the panel and ship it to all the customers. While this works from a standpoint of providing a flexible configuration, including the connector on the base panel increases the cost for the consumer that does not desire to add additional components. This added expense becomes more problematic as the performance and cost of the connector increases. Therefore, it would be beneficial to provide a connector that can be added when the additional panel (and associated components) is added. Existing designs that can provide certain such benefits include what is known as a co-edge connector. However, existing co-edge connector designs are not well suited to coupling different sized panels together in a convenient manner. Therefore, further improvements in the design of such co-edge connectors would be appreciated.

Co-edge connectors are used to provide signal paths between signal traces on two different panels. One further issue is that as the performance of the components mounted on the panels that are coupled with the co-edge connector increases, the rate of communication between the components on the two panels also needs to increase. Thus, for example, adding a second panel with high performance modules to the system of high performance modules on a first panel is not as beneficial if the components on the two panels cannot communicate in an effective manner. One way to address this is to increase the number of signal paths (which are typically differential signal pairs as the data rate increases) between the first and second panel. The problem with such an approach is that each additional signal path takes up more space on the panel. Therefore, for certain applications it would be beneficial to have a co-edge connector that could provide faster communication performance over each signal path.

SUMMARY OF THE INVENTION

An edge connector is provided. The connector includes a housing with coupled terminals configured to engage one or more pairs of signal traces on a first panel and on a second panel and transfer signals between the signal traces on the first and second panel. The connector may include locking features to secure the connector to the first and/or the second panel. The design of the connector may facilitate high-speed data communication per signal pair. Certain configurations of the connector may be used for co-planar configurations. Certain configurations may couple together panels of different thicknesses.

BRIEF DESCRIPTION OF THE DRAWINGS

The present invention is illustrated by way of example and not limited in the accompanying figures in which like reference numerals indicate similar elements and in which:

FIG. 19*b* is an enlarged view aa of the embodiment depicted in FIG. 19*a*.

FIG. 19*c* is a perspective view taken along the line bb in FIG. 19*b*.

DETAILED DESCRIPTION OF THE ILLUSTRATED EMBODIMENTS

Figure 1A:
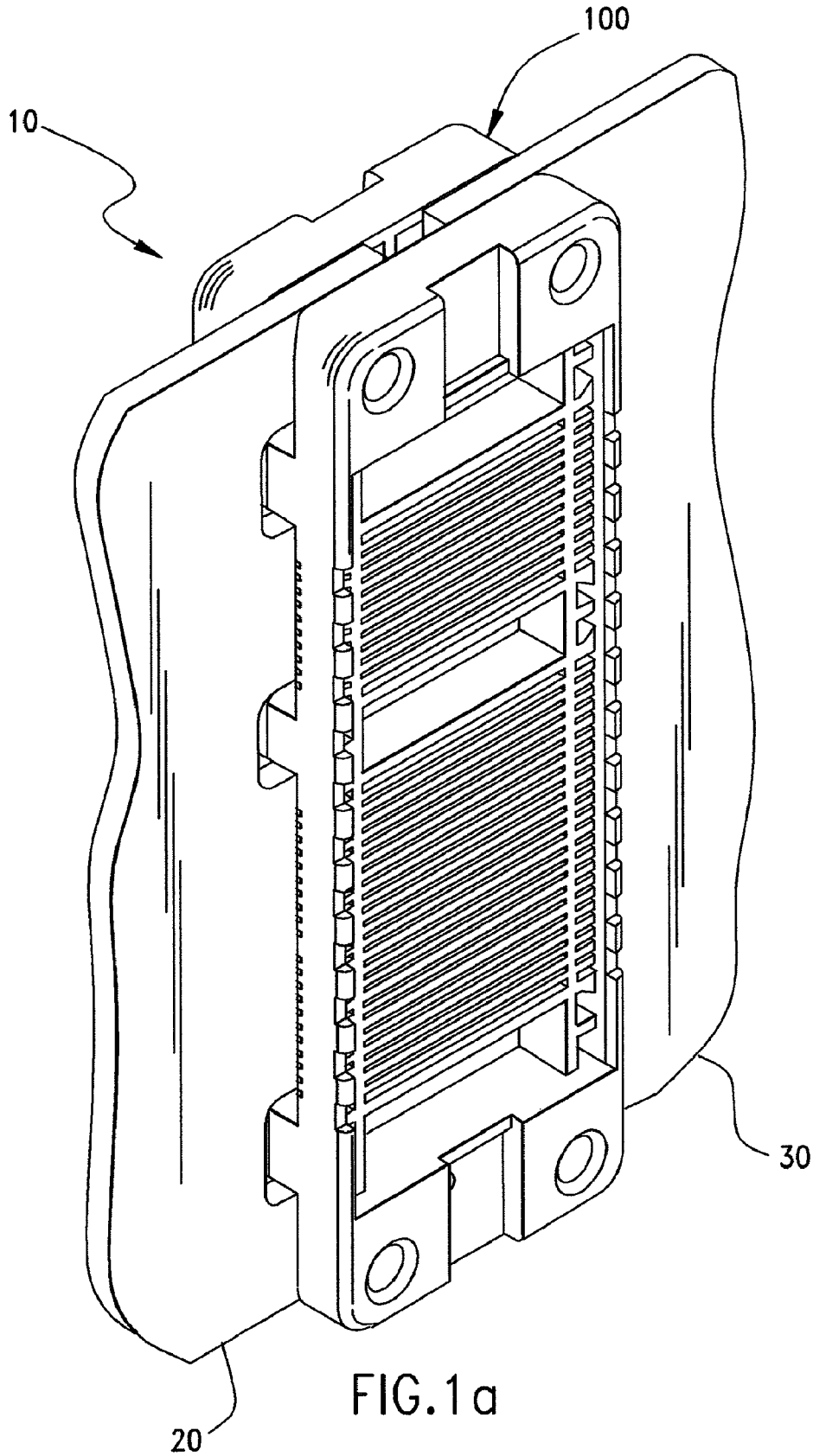
FIG. 1*a* is a perspective view of an exemplary embodiment of a connector mounted to two dimensionally similar panels.

As required, detailed embodiments are disclosed herein; however, it is to be understood that the disclosed embodiments are merely exemplary and representative of features which may be embodied in various forms. Therefore, specific details disclosed herein are not to be interpreted as limiting, but merely as a basis for the claims and as a representative basis for teaching one skilled in the art to variously employ the present disclosure in virtually any appropriate manner, including employing various features disclosed herein in combinations that might not be explicitly disclosed herein.

Before describing the Figures in detail, it should be noted that, in general, performance gains have become increasingly difficult to obtain. For example, thermal issues have raised a substantial barrier to performance improvements previously available simply by increasing the operating frequency of a particular component. While a connector is often a passive component and therefore generates less heat, typically through power dissipation, connectors also affect the thermal performance of systems and can restrict air flow otherwise used to cool a system. Therefore, in high-performance solutions, thermal management has become more important. Furthermore, as the operating frequency increases other problems with signal integrity come into play. Thus, it has been determined that a low-profile edge connector that can both provide high performance and also avoid significant degradation of air-flow across the panel has the potential for providing a substantial benefit to the overall system.

In general, high speed connectors exist in a number of configurations. However, to date it has been difficult to provide a high speed connector, such as a connector that can provide at least 8 Gbps, 12 Gbps or even greater Gbps levels per signal path and that can also be used to couple the traces on the edges of two adjacent panels. Furthermore, increases to levels approaching 30 Gbps, while being contemplated in the backplane arena, have not been considered for edge connectors. However, such speeds in an edge connector have the potential to allow an edge connector to displace a conventional backplane connector.

It should be further noted that recent improvements have made it possible to obtain greater utilization of multiple processing cores without the need to rewrite an application. For example, RAPIDMIND INC. has software that allows applications written for single cores to be run on a number of cores. Other applications are designed to take advantage of multiple processors on multiple panels and allow for increased performance as additional processors are coupled to the system. Thus, the ability to couple a larger number of processors (e.g., going wider) together can provide tremendous effective computing power. One problem with going wider, however, is that when a larger number of processors work together, they often need to share substantial amounts of data at rates heretofore not readily possible in low profile connectors such as edge connectors. Therefore, except for certain limited applications, existing communication speeds between panels have the potential to limit the ability to design architectures that would enable higher communication speeds while avoiding higher cost packaging configurations. As can be appreciated, however, the benefits of higher data transfer performance have far ranging applications and thus high-speed edge connectors have a wide range of potential uses.

As noted above, signals are transmitted over a signal pair. For higher performance applications, a signal pair can be provided by a differential signal pair, which has the benefit of being more resistant to spurious signals. For certain applications, however, the signal pair may be singled-ended.

Figure 1B:
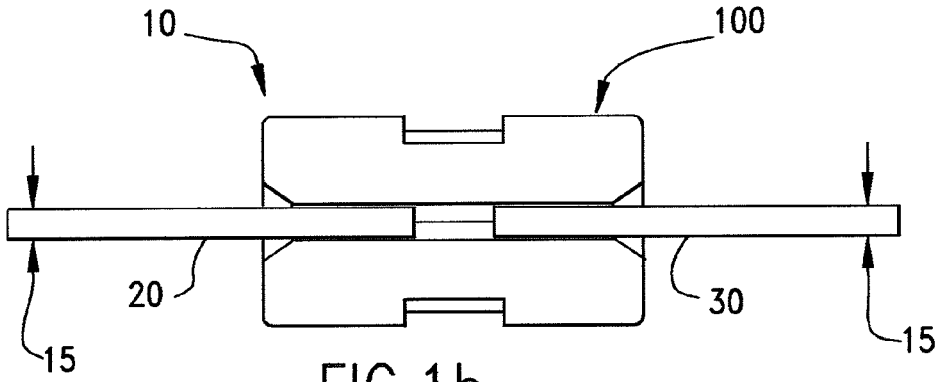
FIG. 1*b* is an side elevational view of the embodiment illustrated in FIG. 1*a*.

FIGS. 1*a* and 1*b* illustrate an embodiment of a connector assembly 10 that includes a first panel 20 and a second panel 30 coupled together by a co-edge connector 100. In an embodiment, the panels may comprise a PCB with traces passing through the PCB. In another embodiment, the panel may comprise an insulative material with conductive traces mounted on a surface edge and coupled to flexible wires. As can be appreciated from FIG. 1*b*, the panels 20, 20 are aligned in a co-planar configuration and both have a first thickness 15.

Figure 1D:
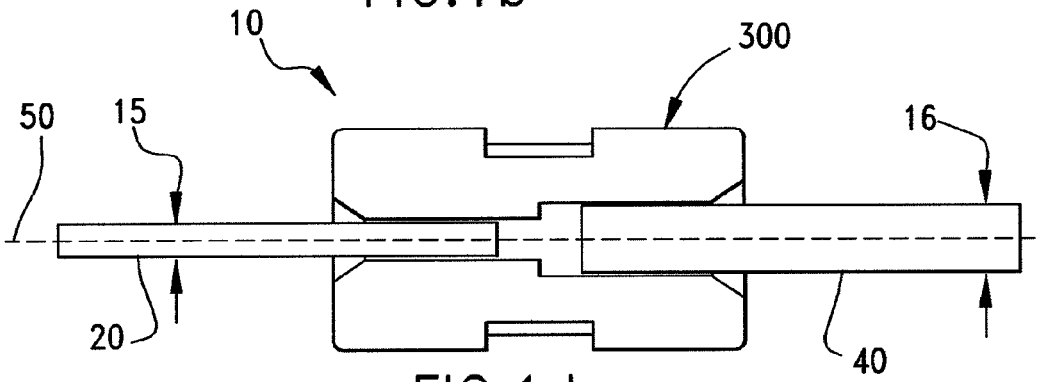
FIG. 1*d* is an side elevational view of the embodiment illustrated in FIG. 1*c*.
Figure 1C:
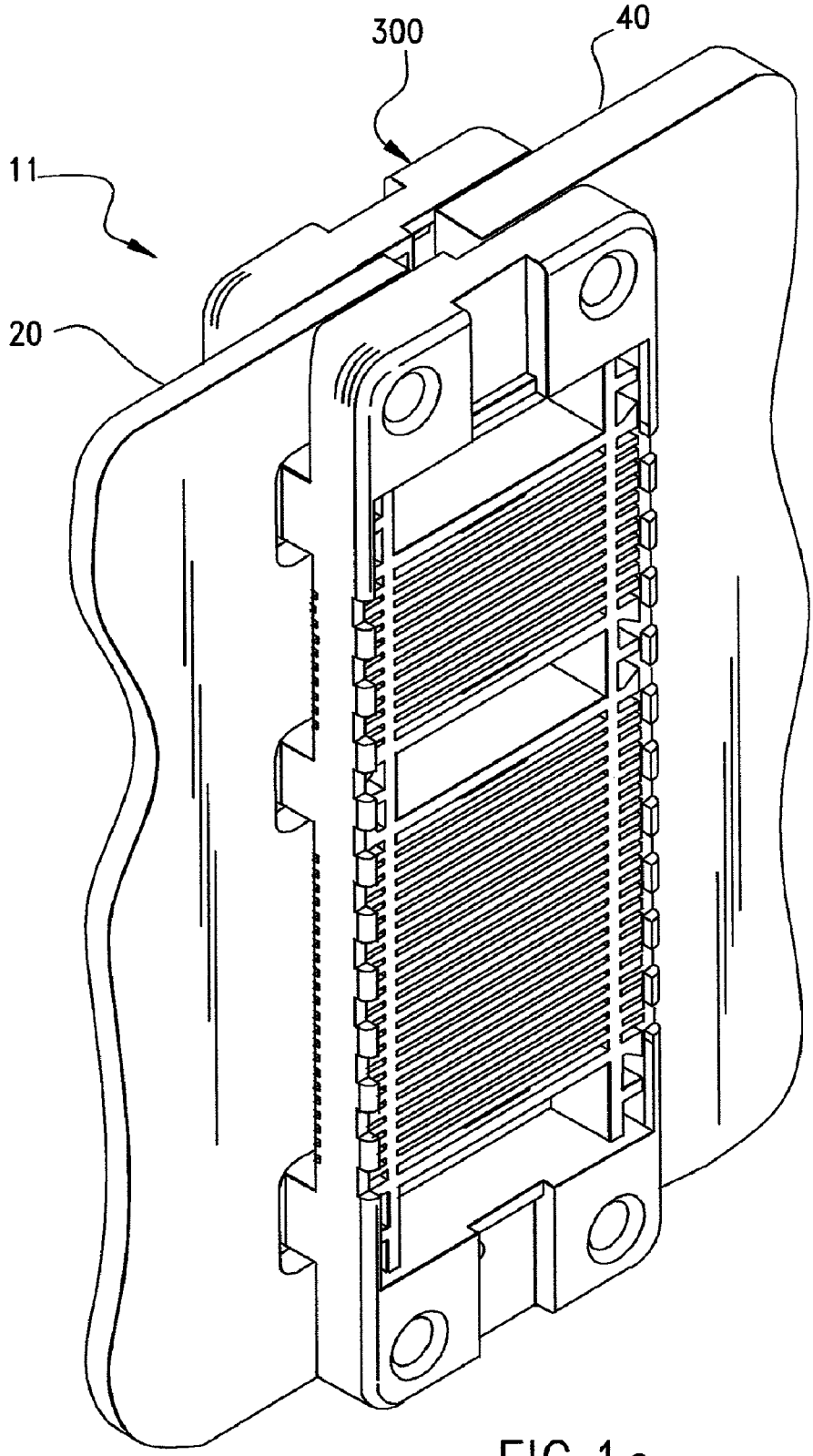
FIG. 1*c* is a perspective view of an exemplary embodiment of a connector mounted to two dimensionally similar panels.

FIGS. 1*c* and 1*d* illustrate another embodiment of a connector assembly 11 that includes a connector 300 coupling a first panel 20. While the overall configuration is similar to that depicted in FIGS. 1*a* and 1*b*, the panel 20 has the first thickness 15 and the panel 40 has a second thickness 16 that is greater than the first thickness 15. However, as depicted, the panel 20 and panel 40 are still co-planar. One benefit of remaining co-planar is that if both sides of the panel include signal traces, the signal path on both sides of the connector can be kept the same. As will be illustrated below, this allows the same terminal to be used on both sides of the connector and also helps ensure the signal has temporal integrity on both sides of the connector by ensuring symmetry to both sides of the PCB, which can be provided by maintaining symmetry to the midplane of the PCB.

Figure 2:
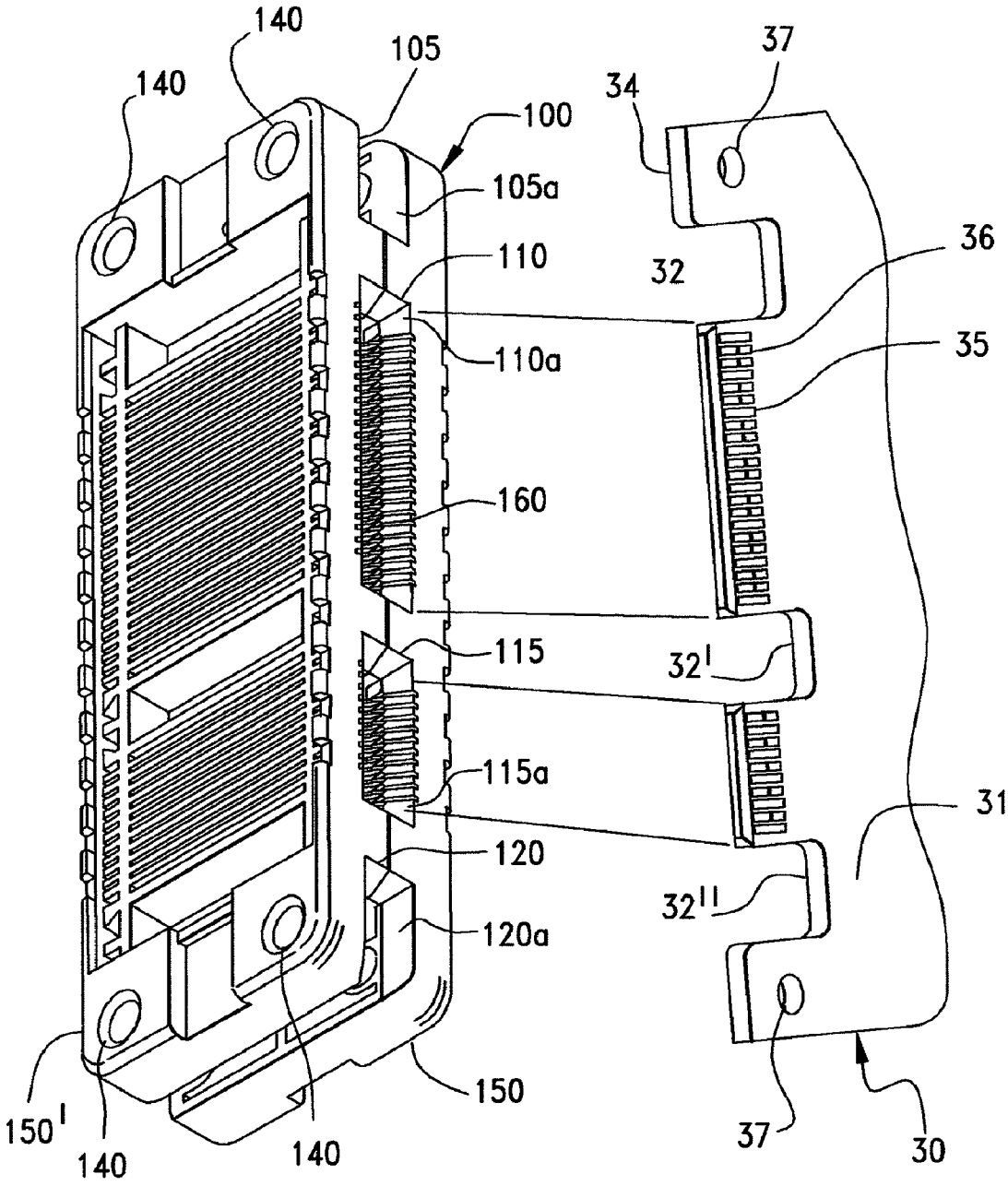
FIG. 2 is a perspective partial exploded view of an exemplary panel and connector assembly.
Figure 3A:
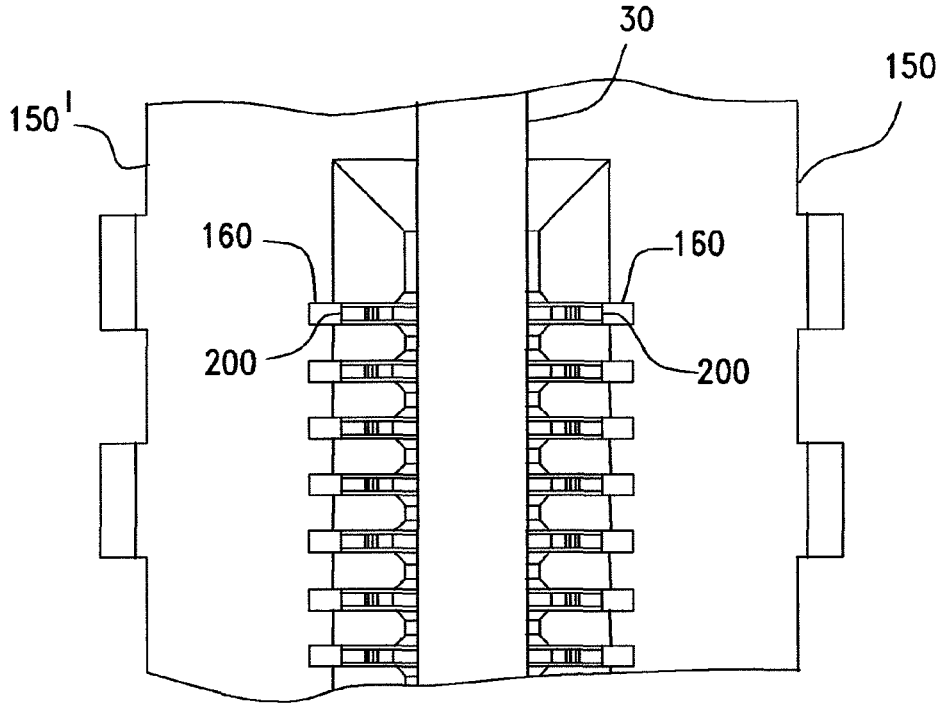
FIG. 3*a* is a cross-section view of an embodiment of a connector with terminals position on both sides of the connector.
Figure 3B:
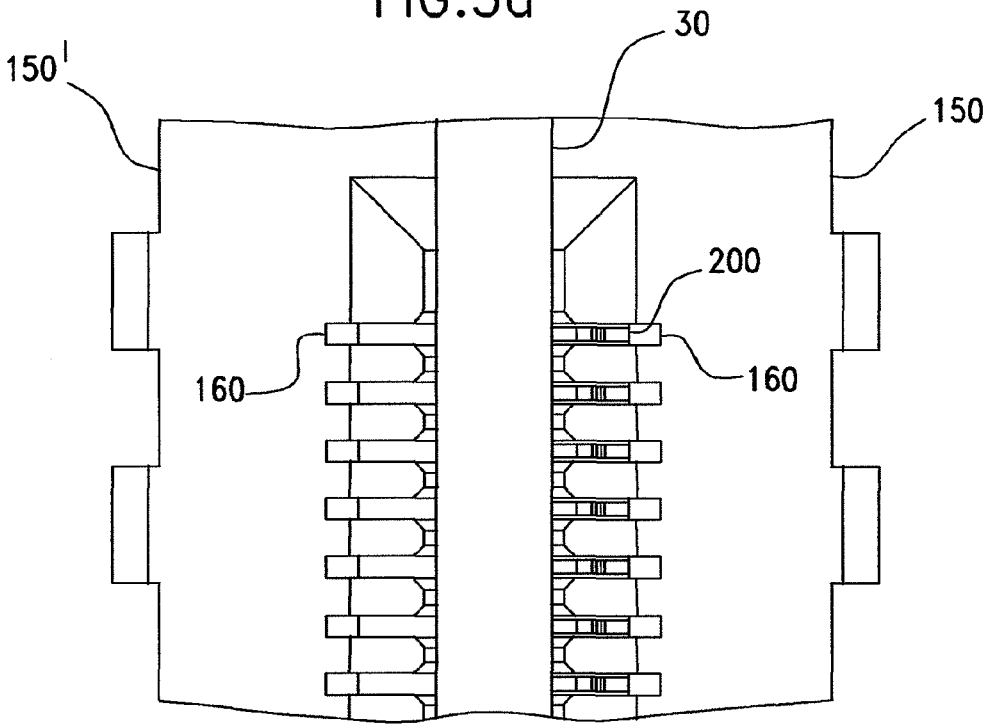
FIG. 3*b* is a cross-section view of the embodiment depicted in FIG. 3*a* with the terminals position on one side of the connector.

FIGS. 2-3*b* illustrate some additional features regarding the interface between a panel and a connector. As depicted, the connector 100 includes a first housing 150 and a second housing 150' that are joined together and form a plurality of panel channels 105, 110, 115 and 120 that are keyed and configured to receive the panel 30 with notches 32, 32' and 32" spaced apart in a particular configuration. The panel 30 may include signal traces on a first surface 31 of the panel 30 as well as the surface on the opposite side of the panel so that terminals 200 in the connector 100 couple to both signal traces. However, if signal traces are only included on surface 31, the terminals 200 may be omitted from one side of the connector as well. Alternatively, the terminals 200 may be provided in both the connector housing 150, 150' regardless of the existence of signal traces on panel 30 and the terminals may be used to help center the connector on the panel.

While not required, the edge connector may be permanently mounted to the panel 30 via a locking feature, which in an embodiment may include connector apertures 140 that align with panel apertures 37 so that a desired fastener, such as, but without limitation, a screw or pin or rivet may inserted in the apertures 140, 37 and used to secure the connector 100 to the panel 30. Furthermore, in an embodiment the connector may be configured to be securely mounted to both panels. In an embodiment, the aperture 140 may be adapted to accept a screw and in such a case the aperture 140 may be configured with one side that provides clearance for threads on the screw while the other side of the aperture 140 is configured to securely receive the threads.

To aid insertion of the panel 30 into the panel channels 105, 110, 115 and 120, chamfers 105*a*, 110*a*, 115*a* and 120*a* are respectively provided. The terminals 200 are positioned in terminal grooves 160 and spaced apart so as to engage the signal traces at a desired pitch, which in an embodiment may be 0.8 mm. If the terminals are 0.6 mm wide, then terminals will include 0.2 mm of space between adjacent terminals and, in a ground, signal, signal, ground, signal, signal, ground, signal . . . pattern 10 differential signal pairs can be positioned in about 25 mm. Thus, depending on the provided data rate, a performance of about 160 Gbps/(inch of panel edge) or more is possible from a double sided connector. Furthermore, certain embodiments may provide 200+ Gbps/(inch of panel edge). For example, in a configuration configure to provide 12.5 Gbps for each signal pair, a double sided connector could provide a performance of 250 Gbps/(inch of panel edge). Greater performance per inch of panel edge is also possible. For example, a connector configured to provide 30 Gbps per signal pair at a pitch of 0.8 mm with a repeating ground, signal, signal pattern as discussed above could provide about 600 Gbps/(inch of panel edge). Therefore, certain embodiments can provide substantial performance per inch of edge panel space. It should be noted that the above performance per inch of panel edge refers to the space taken up by the signal traces and the "(inch of panel edge)" does not include the additional space taken up by the housing that supports the terminals.

The disclosed connector can also provide high performance compared to the total space along the edge of the panel taken up by the connector (e.g., data rate/inch of total connector space). Depending on the number of signal pairs that are used, it is also possible to provide 200+ Gbps/(inch of total connector space). For example, in an embodiment similar to the embodiment depicted in FIG. 1, 20 differential signal pairs can be provided in the connector that takes up about 2.3 inches of total board edge space, assuming a ground, signal, signal, ground, signal, signal, ground, signal . . . pattern is used (e.g., a differential signal configuration as discussed below). If the signal pairs provided about 25 Gbps performance, then a performance of about 217 Gbps/(inch of total connector space) could be provided using a 0.8 mm pitch. Furthermore, if just the larger section of 14 signal pairs in the larger panel channel 110 were used for high speed data communication (the remaining terminals being used to provide, for example, power or slower data speeds), a performance of 35 Gbps per signal pair would still provide greater than 200 Gbps/(inch of total connector space). However, as can be appreciated, the ability to meet such a specification is somewhat dependent on the size and configuration of the housing, the number of signal pairs and the mechanism, if any, used to secure the connector to the panel. Furthermore, as noted, certain connectors may also include terminals for transmitting power and/or slower data rates. Therefore, raw performance measurements based on the portion of the panel used to provide signal traces for high speed communication can be more readily compared. However, for the system architect, a comparison of performance per (inch of total connector space) may be quite valuable because other parameters (such as current delivering ability) can be specified so as to ensure the connector provides a desirable overall design.

Figure 4:
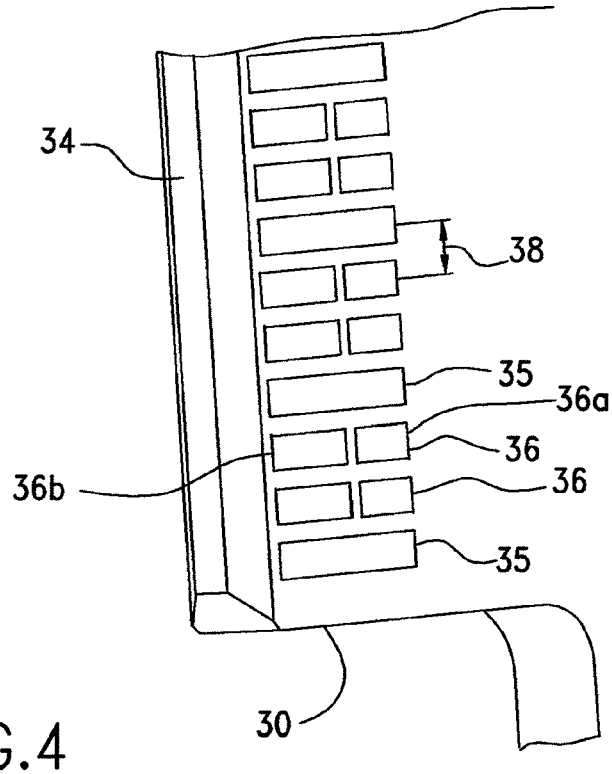
FIG. 4 is a partial perspective view of a panel edge.

While a number of different configurations exist for signal traces on a panel, FIG. 4 illustrates an exemplary signal trace configuration. The signal traces are arranged in a ground trace 35, signal trace 36, signal trace 36 repeating pattern with the signal traces having a pitch 38 (which may be, but is not limited to, 0.8 mm). As can be appreciated, the signal trace 36 may be split so that an initial lead-in portion 36*b* of the signal trace 36 is insulated from a contact portion 36*a* of the signal trace 36. This allows the panel 30 to have a reliable mechanical engagement with the terminals while reducing the impedance discontinuity experienced when the signal travels between the terminal and the signal trace (thus improving the performance of the system).

Figure 5A:
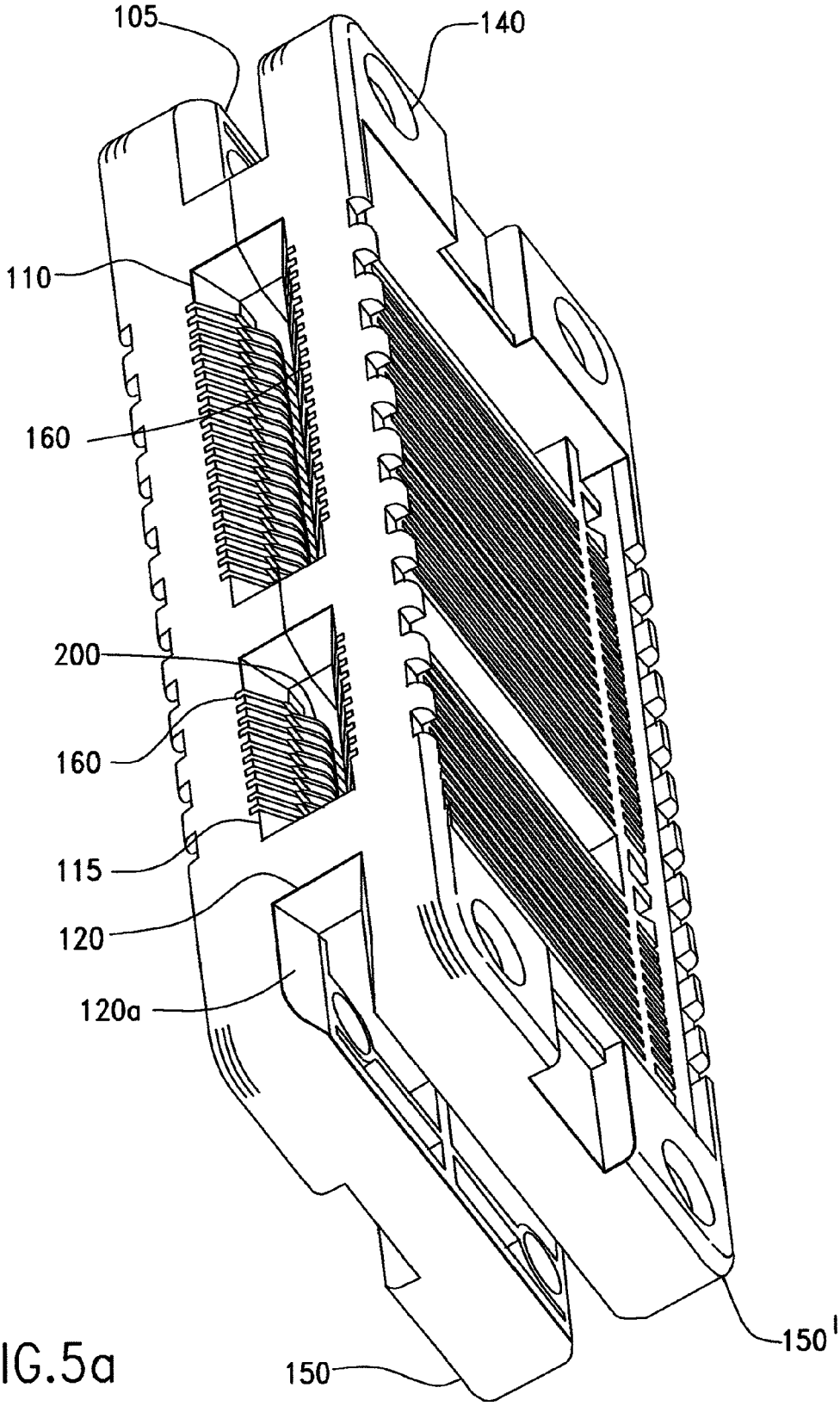
FIG. 5*a* is a perspective view of an exemplary embodiment of a connector configured to couple two panels of the same thickness.
Figure 5B:
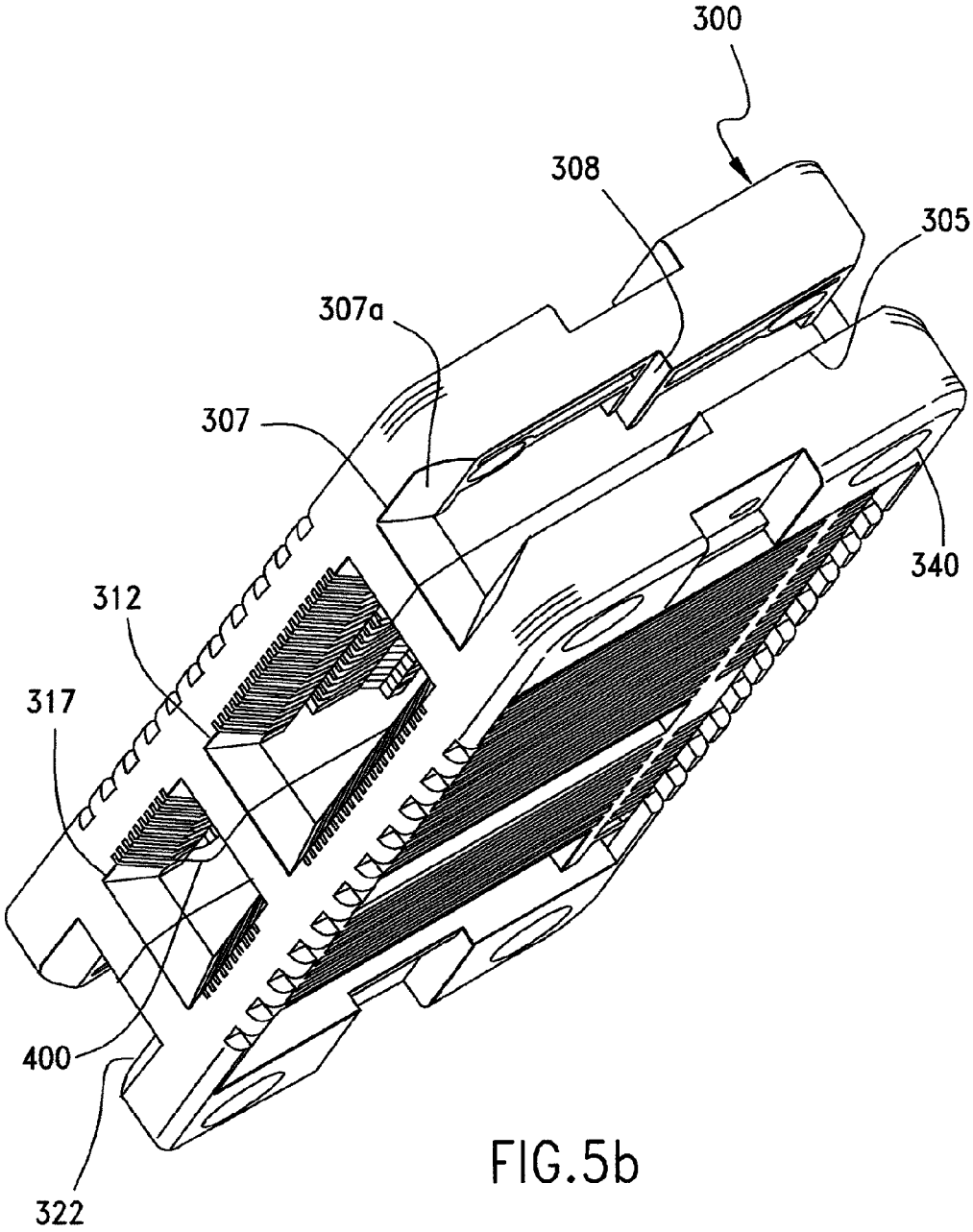
FIG. 5*b* is a perspective view of an exemplary embodiment of a connector configured to couple two panels that each have a different thickness.
Figure 6:
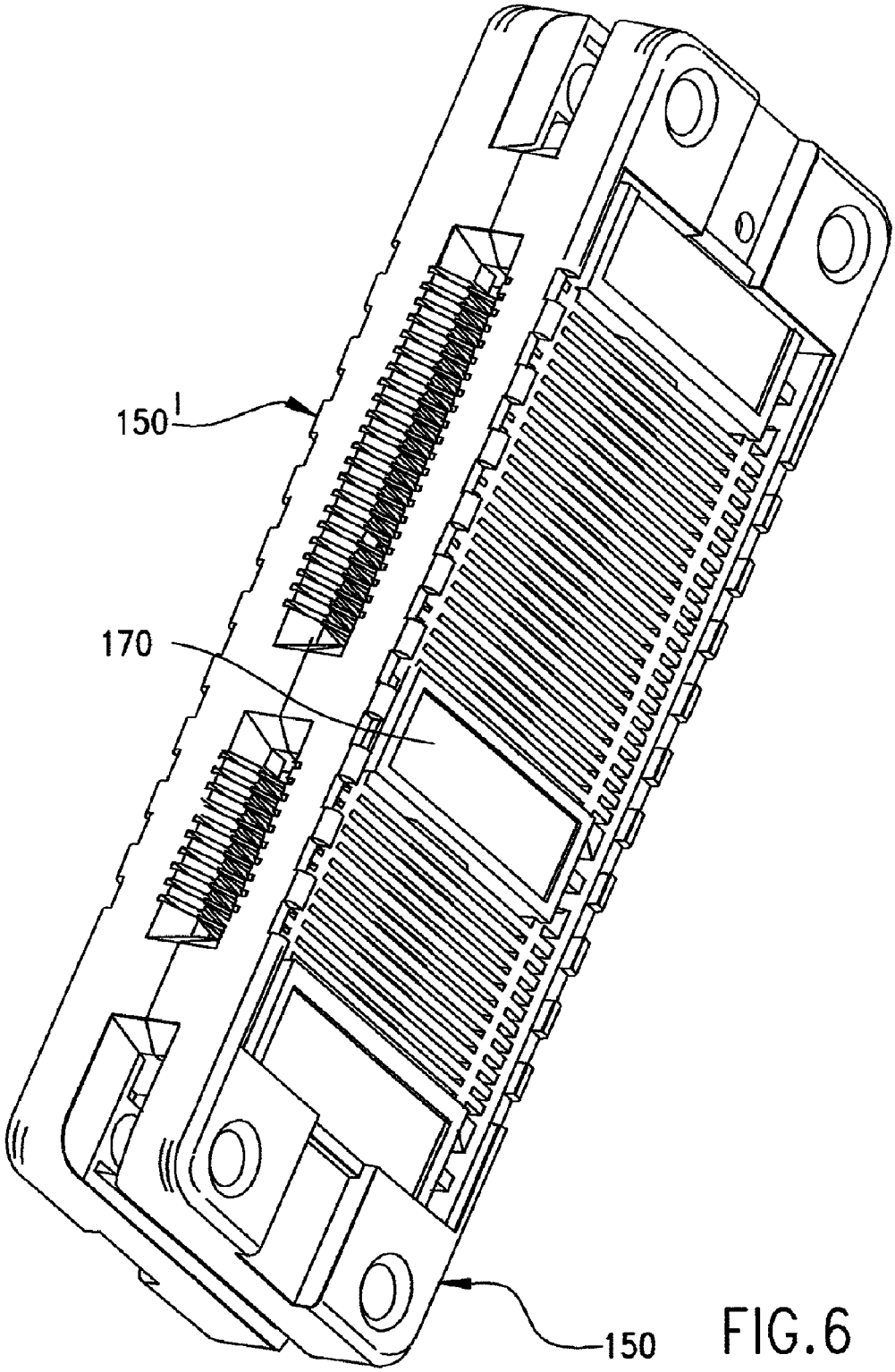
FIG. 6 is another perspective view of an exemplary embodiment of the connector depicted in FIG. 5*a*.

The panel 30 may include a lead edge 34 that is includes a chamfer so as to improve the ease of insertion of the panel 30 into the connector 100. It should be noted that while a high degree of signal performance is possible for differential signal pairs, for certain applications a signal pair consisting of a single signal wire and a ground wire may also be used to provide relatively high levels of performance. In addition, certain embodiments of the connector 100 may include terminals that are used for lower performance signal transfer and/or power distribution. For example, in FIG. 5*a* the connector 100 includes panel channel 110 that could be configured to provide differential signal pairs while panel channel 115 could be configured to provide either power or lower speed signals over terminals. It has been determined in particular that an alternating power supply configuration of terminals (e.g., positive terminal coupled to negative next to another positive terminal coupled to a negative terminal . . . ) can provide beneficial levels of current while providing lower levels of inductance because the area of two adjacent terminals is relatively small. As can be appreciated, reduced inductance is useful in a situation where high speed current switching is desirable. Thus, a single connector may transfer both signals and power with the signals being transferred at high-speed while the power terminals are in an alternative polarity configuration suitable for high-speed switching as well. As the connector is being coupled to an edge of the panel, the connector could also be configured to include other terminals configurations, such as a blade terminal suitable for coupling to mating blade terminals so as to enable transferring of higher power levels. The use of different shaped terminals in a single connector is known and will not be discussed further herein.

It should be noted that panel channel 120 provides a substantially uniform sized opening. In contrast, connector 300 is configured to provide a channel 305 that is communication with panel channel 307. The panel channel 307 (as well as the panel channels 312, 317 and 322) is configured to receive a thicker panel. A shoulder 308 couples the panel channel 307 with the panel channel 305. Terminals 400 may be positioned in connector 300 in a manner discussed herein.

Figure 7:
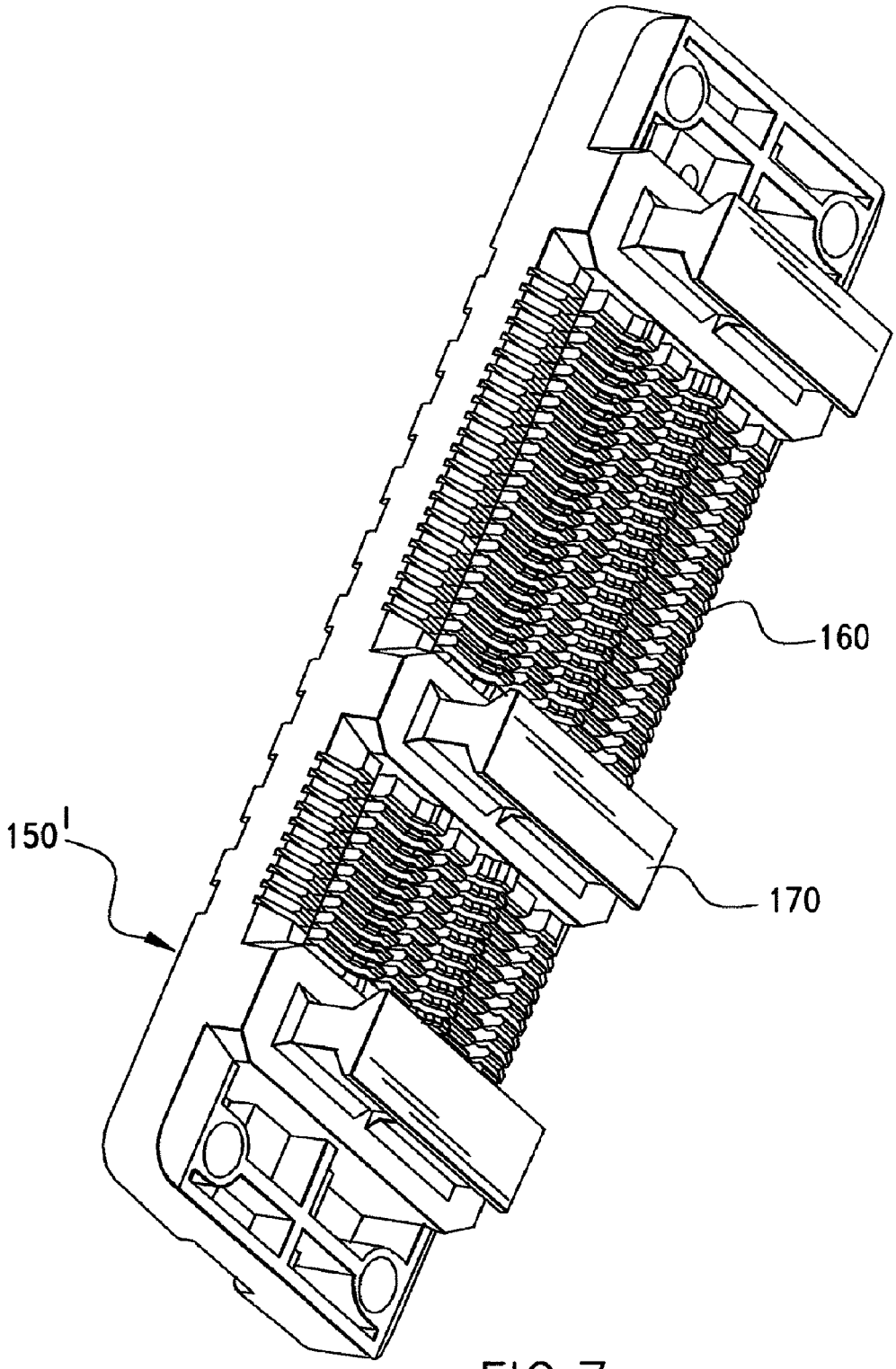
FIG. 7 is a perspective view of a first housing that comprises a portion of the connector depicted in FIG. 6.

To secure the first and second housing 150, 150' together, coupling member 170 may be staked so as to securely hold the housing together. FIG. 7 illustrates the coupling member 170 of housing 150' (with housing 150 not shown for illustrative purposes) after being heat staked. The housing 150 includes coupling aperture 172, which may be a number of apertures divided by a wall or may be a single aperture. Thus, the terminal grooves 160 and terminals 200 (or 400) may be aligned and secured in position respective to each other.

Figure 8:
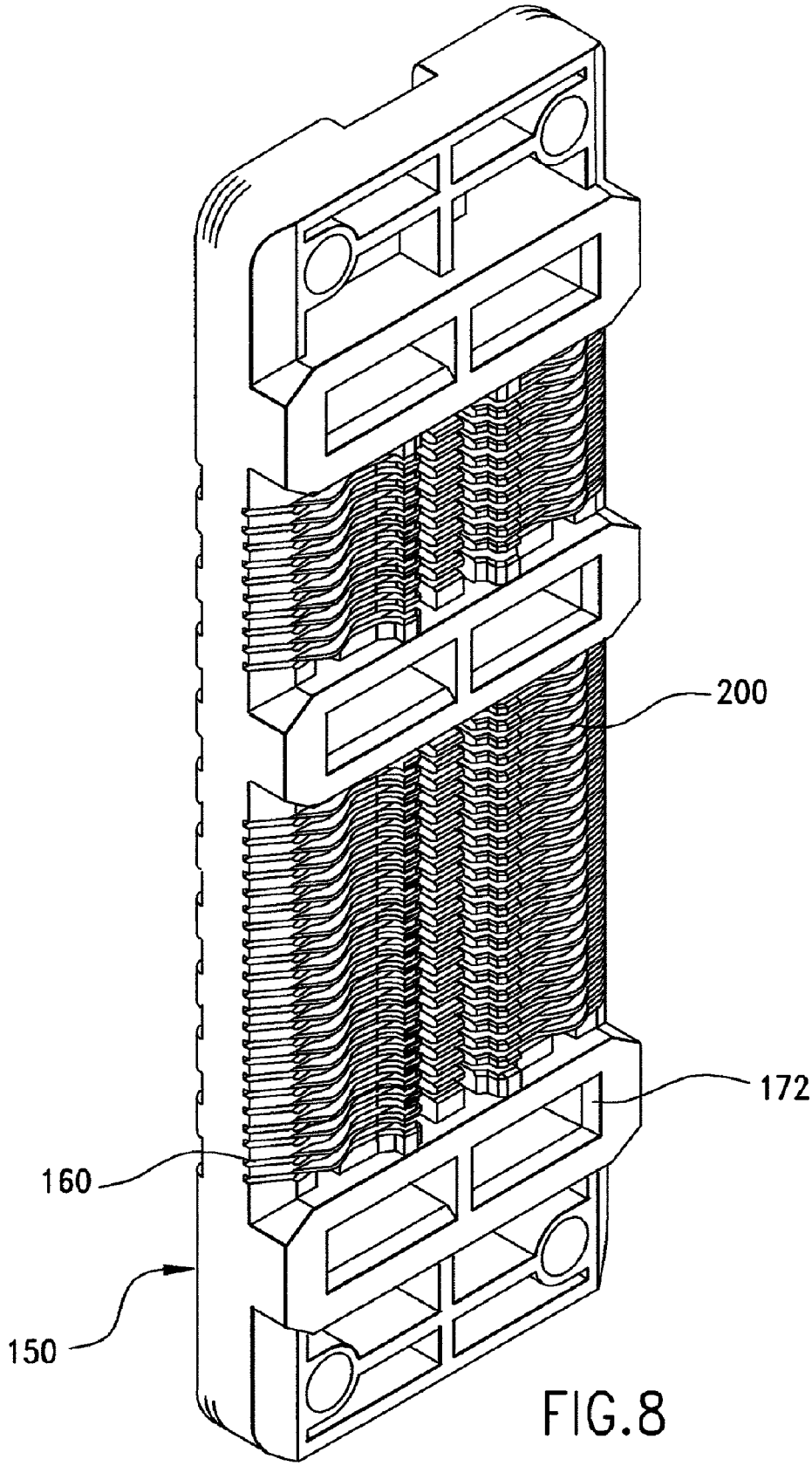
FIG. 8 is a partial perspective view of the connector depicted in FIG. 6.

As can be appreciated from FIG. 8, the housing 150 includes a first side 150*a*, a second side 150*b*, a third side 150*c*, a fourth side 150*d*, a first face 150*e*, and a second face 150*f*. Similarly, the housing 150' includes a first side 150'*a*, a second side 150'*b*, a third side 150'*c*, a fourth side 150'*d*, a first face 150'*e*, and a second face 150'*f*. As illustrated, the terminal grooves 160 are on the first surface 150*e* and extend between the first side 150*a* and the second side 150*c*. The housing 150' may be similarly configured. It should be noted that while the terminal grooves 160 are depicted as extending a portion of the distance between the first side 150*a* and the third side 150*c* equal to the entire distance, in an alternative embodiment the terminal grooves may extend a portion of the distance between the first and third side that may be less than the entire distance. It is further noted that the terminal does not need to extend the full length of the terminal groove.

Figure 10:
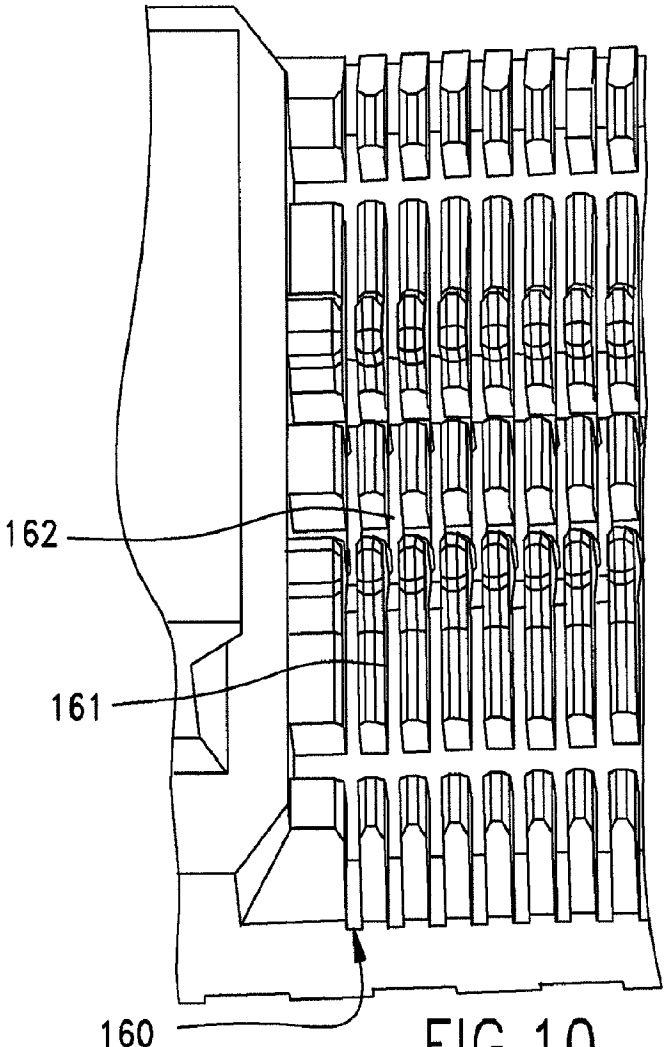
FIG. 10 is another perspective view of the partial connector depicted in FIG. 9.
Figure 9:
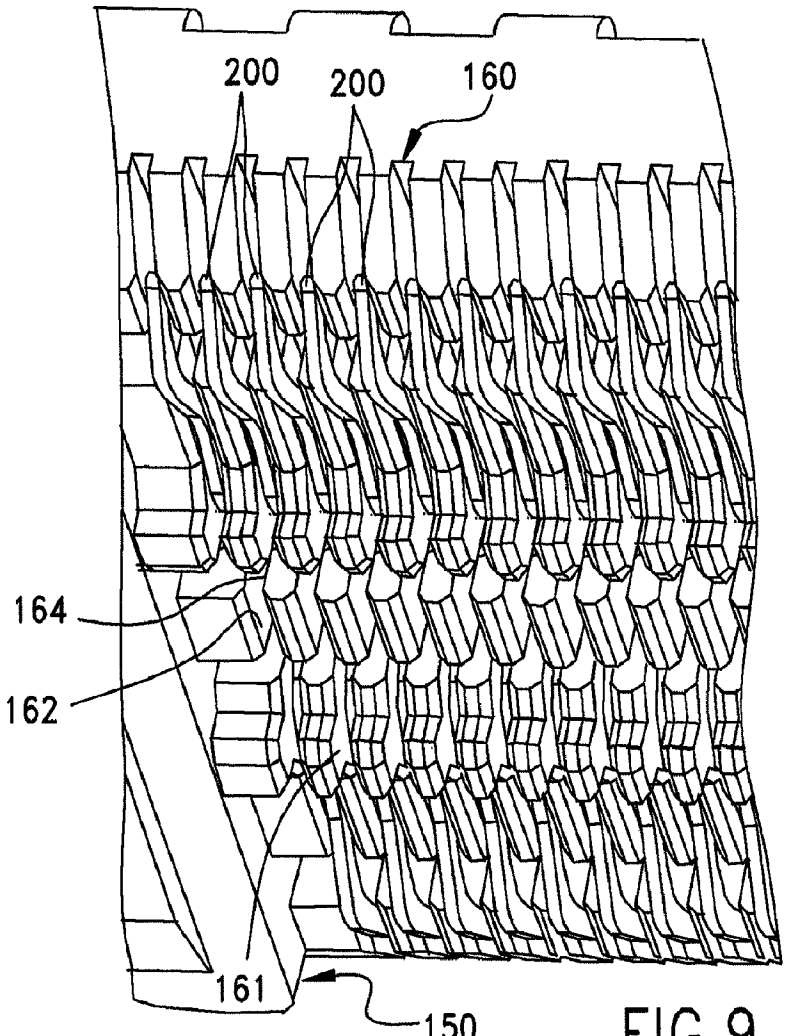
FIG. 9 is an enlarged view of the partial connector depicted in FIG. 8.
Figure 11:
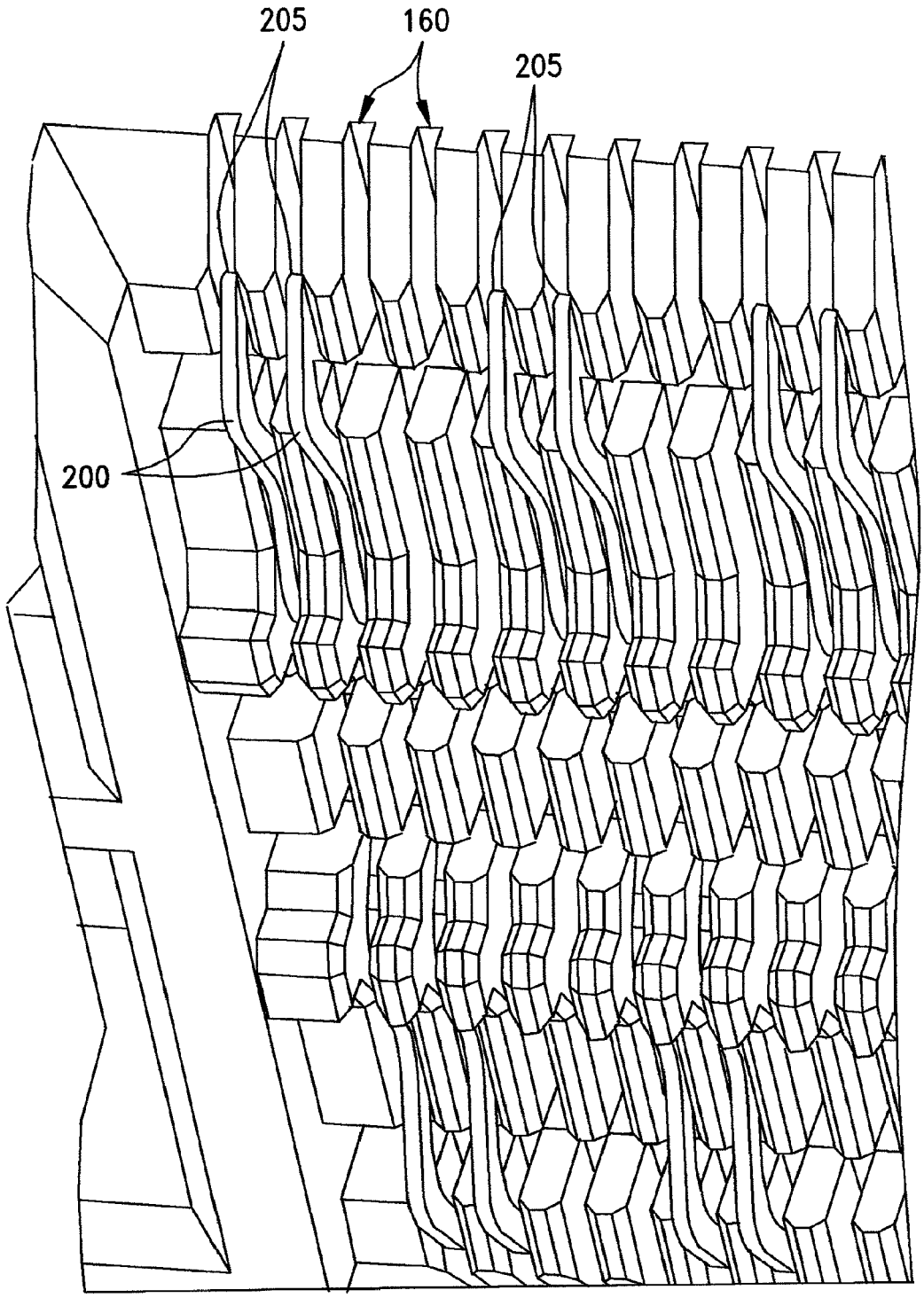
FIG. 11 is a partial perspective view of an exemplary connector with terminals removed.

FIGS. 9-11 illustrate additional details regarding an embodiment of the terminal groove 160. As depicted, the terminal groove 160 includes a stake portion 164 that includes a side wall 162. The terminal groove 160 further includes an additional side wall 161 which can provide guidance for a terminal positioned in the terminal groove 160. Thus, as depicted, the stake portion 164 provides a side wall to help secure the terminal 200 in the terminal groove 160. As depicted in FIG. 9, a continuous repeating pattern of terminals are provided. Such a pattern of terminals would be suitable for, without limitation, a ground, signal, signal, ground, signal, signal, ground . . . type configuration. Thus, two terminals 200 could be used to form a signal pair 205. It should be noted that a space may be provided between two signal pairs, such as is illustrated in FIG. 11. While FIG. 11 illustrates a spacing of two open terminals between each signal pair 205, other configurations are contemplated. For example, the two terminal grooves that are shown without a terminal could be combined to form a single channel. In an embodiment, the width of the empty channel could be varied depending on signal speed, as well as the design of the terminals so as to provide suitable electrical separation between the signal pairs.

It has been discovered that certain aspects of the mating of the terminal in the connector with the signal pad introduce issues in providing a high performance signal transfer. For example, the point of contact where the contact portion 234 engages a corresponding signal trace (see, e.g., FIG. 9*a*, 15*a*, 22*a-b*) and on a panel tends to experience increased capacitance as compared to other locations on the terminal, thus creating an impedance discontinuity. One approach that can help reduce the impedance discontinuity, as noted above and discussed below, is to split the signal traces on the panel. Another feature that can help reduce the impedance discontinuity is to reduce the capacitance at the point of contact, which can be accomplished with a localized reduction in permittivity. The localized reduction in permittivity reduces the experienced discontinuity, which can result in an improvement in associated S-parameter return loss and high-speed insertion loss.

Figure 9A:
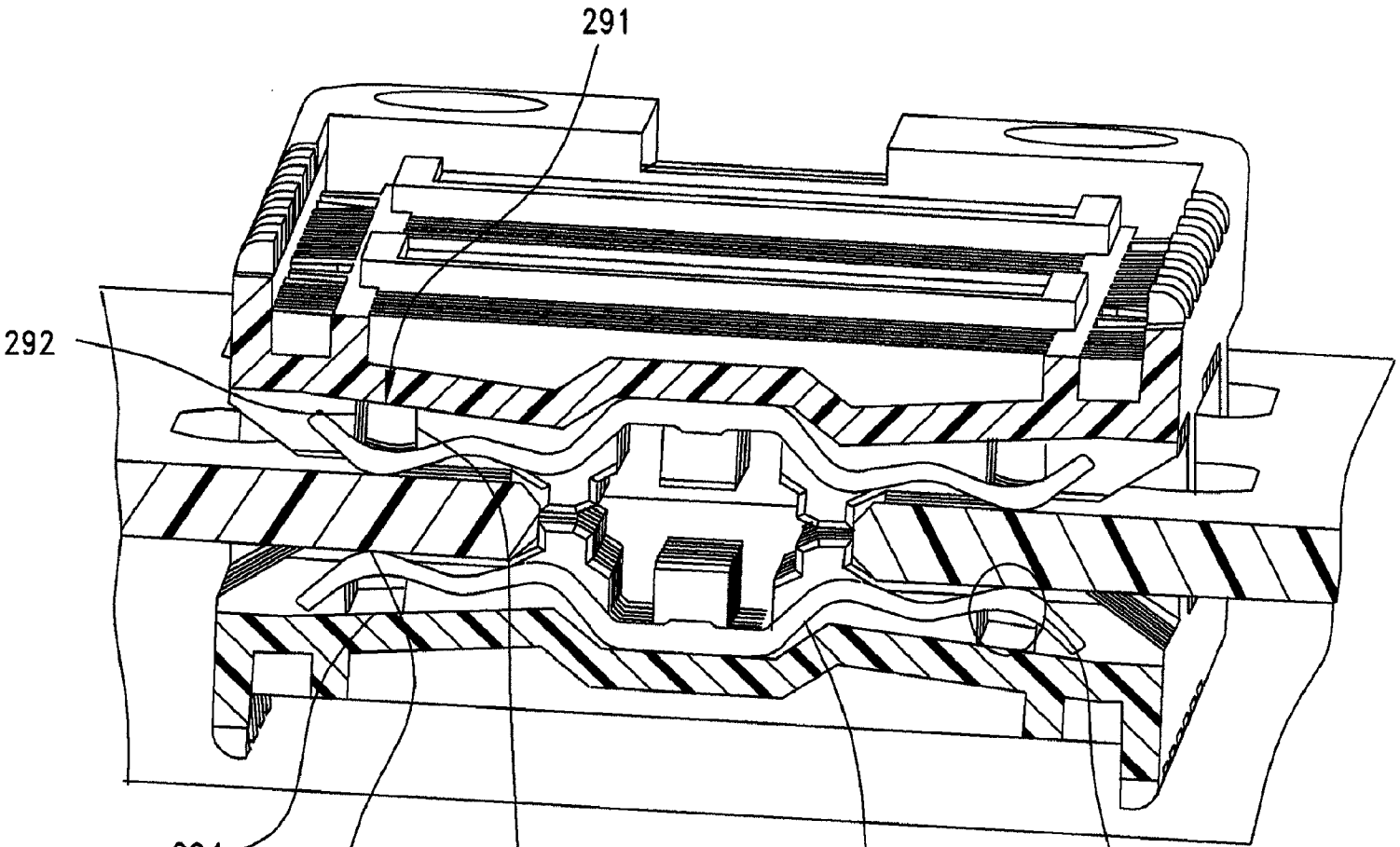
FIG. 9*a* illustrates a perspective view of a cross-section of an embodiment of a connector coupled to two panels.
Figure 9B:
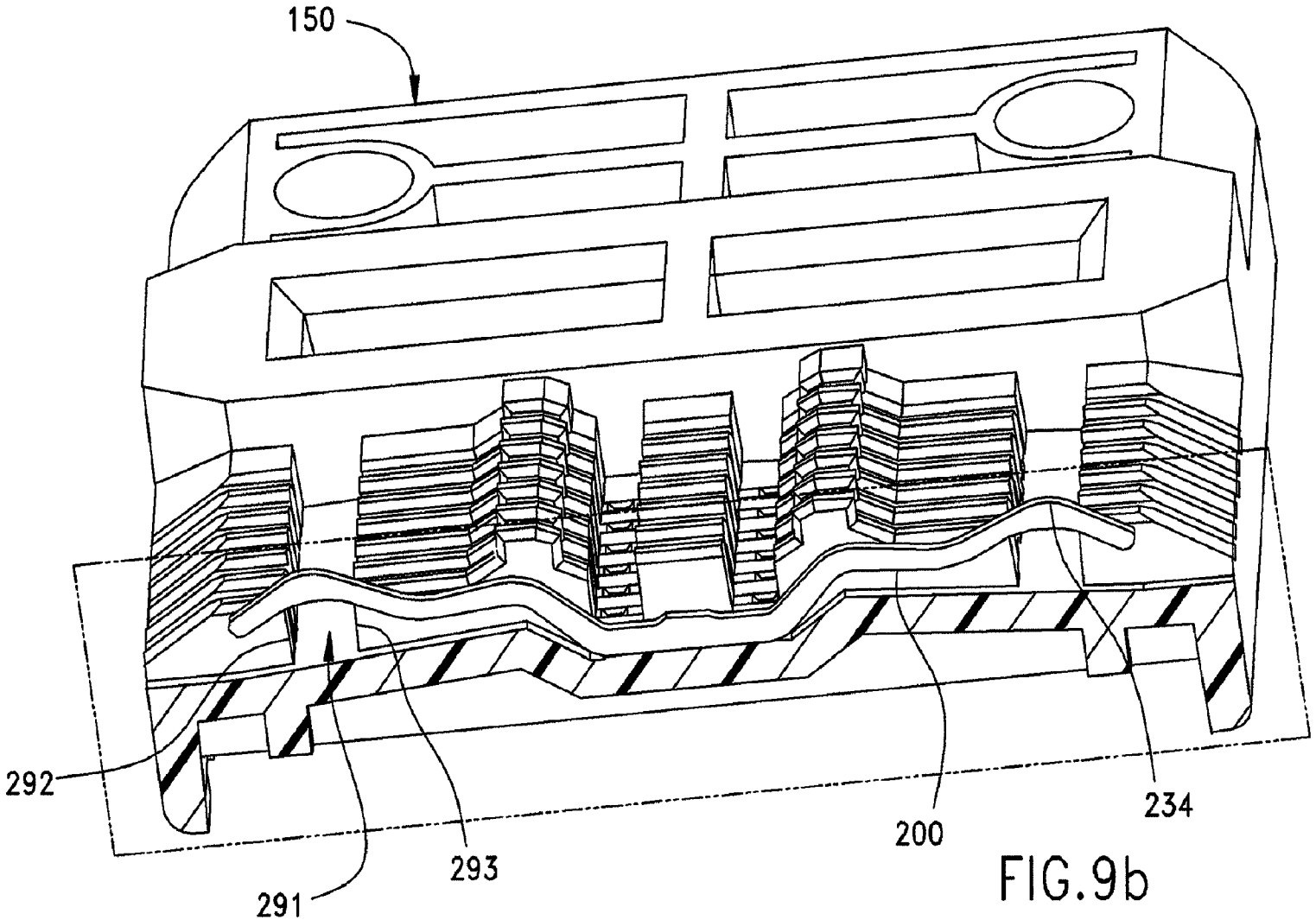
FIG. 9*b* illustrates a perspective view of a cross-section of an embodiment of housing with a terminal positioned in a terminal channel.

FIGS. 9*a* and 9*b* illustrate an embodiment that provides an exemplary regional permittivity reduction, depicted here in the region of the mating interface. Terminals 200 are positioned in a housing 150 so that they engage signal traces (e.g., pads) on a panel. As can be appreciated, the terminal is depicted in a deflected state FIG. 9*a* (as would be experienced when the contact portion engaged a pad on the surface of the panel). Thus, the surface of the panel causes the terminal to deflect when the panel edge and connector are mated. In contrast, FIG. 9*b* illustrates the terminal in a non-deflected position. Thus, the difference illustrates an exemplary embodiment of the distance a terminal may be deflected upon mating of the connector with the panel. As can be appreciated, tolerances of the mating panels will likely affect the desired level of deflection.

As discussed herein, the terminal 200 (of which only one is shown for ease of depiction) may be positioned in the channel 160. When the terminal 200 engages the panel, the channel 160 helps keep the terminal 200 aligned so that it makes contact with the desired signal trace. Thus, the side walls 161 (which may be positioned on both sides of the terminal 200) prevent the terminal 200 from deflecting left or right of the intended location. To reduce the permittivity at the connection between the terminal and the signal trace, a notch 291 may be provided. The notch 291 is depicted as being formed of an edge 292, an edge 293 and an edge 294 and may be positioned approximate the contact point. As depicted, for example, the edge 292 and edge 294 are positioned on opposite sides of the contact point so as to allow the notch 291 to extend on both sides of the contact point. The notch 291 changes the experienced dielectric constant of the material surrounding the terminal and thus acts to reduce capacitance (as well as the regional permittivity). Thus, a regional dielectric variance 290, which may be provided by notch 291 and may be aligned with the contact point where the terminal engages the signal traces, provides a desirable regional permittivity reduction.

As noted elsewhere, end 232 of the terminal 200 may be truncated so as to form end 232'. To help ensure the terminal 200 remains in the desired location during installation, the truncated end 232' and the notch 291 can be configured so that the truncated end 232' extends past edge 292. This allows the notch 291 to provide the regional dielectric variance 290 and helps improve performance of the connector while ensuring a reliable connector interface.

It should be noted that while the notch 291 is illustrated as having a particular shape, other shapes can be provided so as to optimize or modify the regional dielectric variance 290. Thus, the regional dielectric variance 290 of the channel may be configured so as to provide a desired capacitance and corresponding impedance at the connection between the terminal and the corresponding trace on the panel.

Figure 10A:
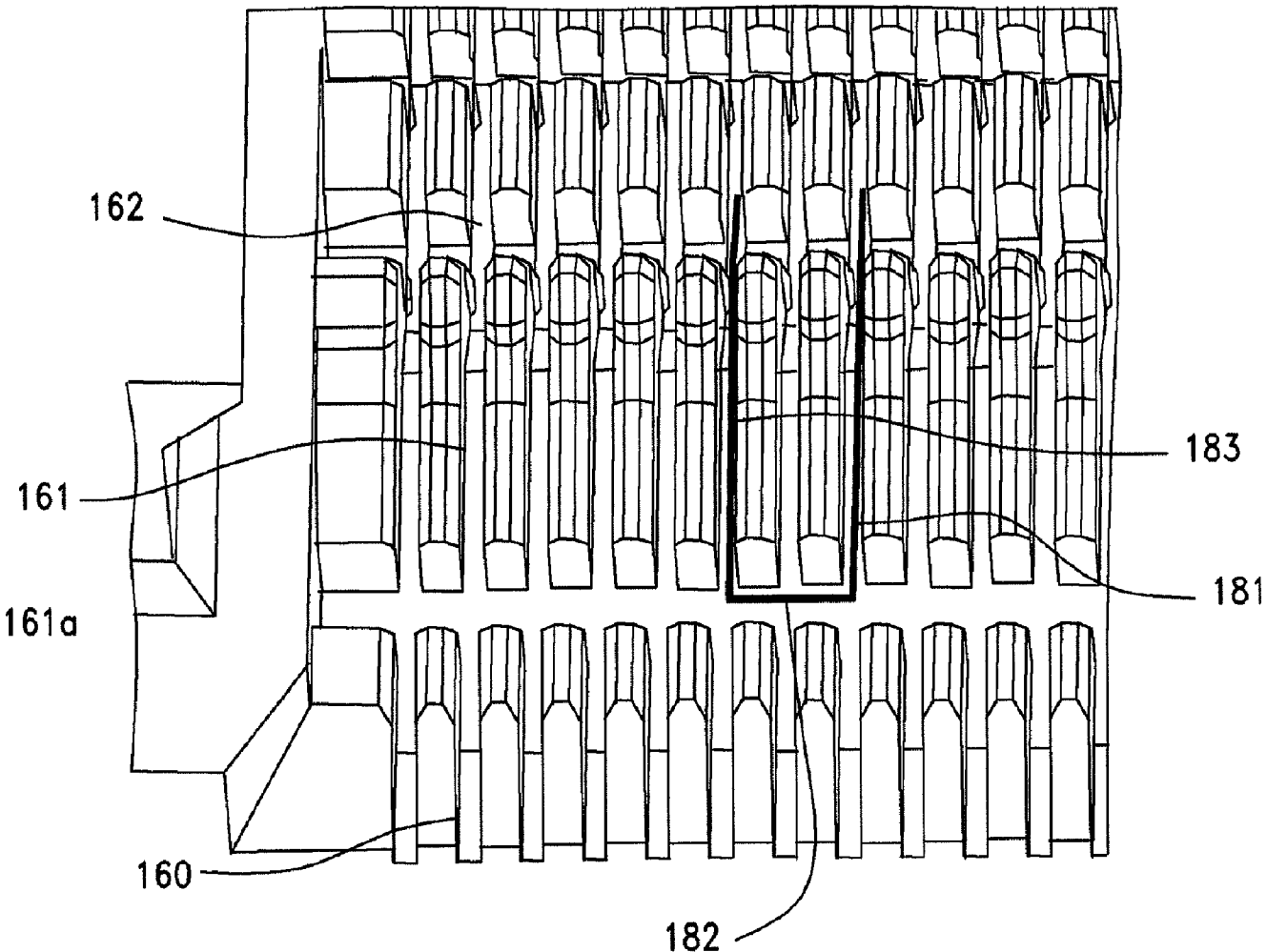
FIG. 10*a* is a perspective view of an exemplary embodiment of a partial connector.

FIG. 10*a* illustrates another feature than may be incorporated into a connector. In particular, the illustrated embodiment show the gap 161*a* provided in the side walls 161 that extend along the terminal groove 160. In an embodiment, the terminals 200 can contact the housing 150 at the stake portion 164 but will be configured so that the terminals 200 do not contact the housing 150 along either the remainder of the terminal groove 160 or at least a portion of the terminal groove. In such an embodiment, a first trace 181 may be positioned in one terminal groove 160 so that a first terminal 200 will contact the first trace 181. A second trace 183 can be provided in a second terminal groove 160 so that a second terminal 200 will contact the second trace 183. A third trace 182 can extend between the first trace 181 and second trace 183 so as to provide a bridge between the two traces (as well as to complete the bridge between the terminals). As can be appreciated, the second trace 182 can extend across the path of where a third terminal 200 would be positioned in a terminal groove 160 but the configuration of the second trace 182 would make so that it did not make contact with the third terminal. For example, the second trace 182 could be positioned in a gap, such as gap 161*a*, or a groove or the terminals could be configured so that they did not make contact with the housing and the terminal grooves at the point where the second trace crosses the terminal grooves (e.g., the second trace crossed the terminal grooves but did not make contact with the any of the terminals). The second trace 182 could also be configured so that it only dipped below the terminal(s) that were not intended to be in contact with the second trace. As can be appreciated, such a design allows for a connector that includes commonizing traces so as to provide a commonized ground(s) structure, which in certain configurations may have electrical benefits (for example, by reducing the effective electrical length of the structure so as to increase the resonance frequency of the ground structure).

It should be noted that while the second trace 182 is illustrated as crossing one terminal, it could also not cross any terminals and thus link adjacent terminals. In addition, the second trace 182 could also cross a number of terminals such as two terminals that might make up a differential pair and may also couple additional traces together. In addition, the gap 161*a* that is used to allow the second trace 181 to bridge at least two other traces may be positioned closer to the stake portion 164 then depicted (such as directly adjacent the stake portion 164). It should be noted that while not required, the commonizing traces may be formed via known plated plastic processes.

Before discussing additional details of terminal configuration, it should be noted that FIGS. 4 and 9 illustrate terminals and pads configured so that all the terminals engage all the pads at substantially the same time. In an embodiment, the position of the pads may be adjusted so that certain terminals make contact with pads at different points during the process of mounting the connector on the panel. Alternatively, the length of some number of terminals may be adjusted so that certain pad(s) are contacted first. As can be appreciated, this can provide assurance that the connector is fully seated as well as providing protection from electrical shocks to the more sensitive circuitry.

Figure 12:
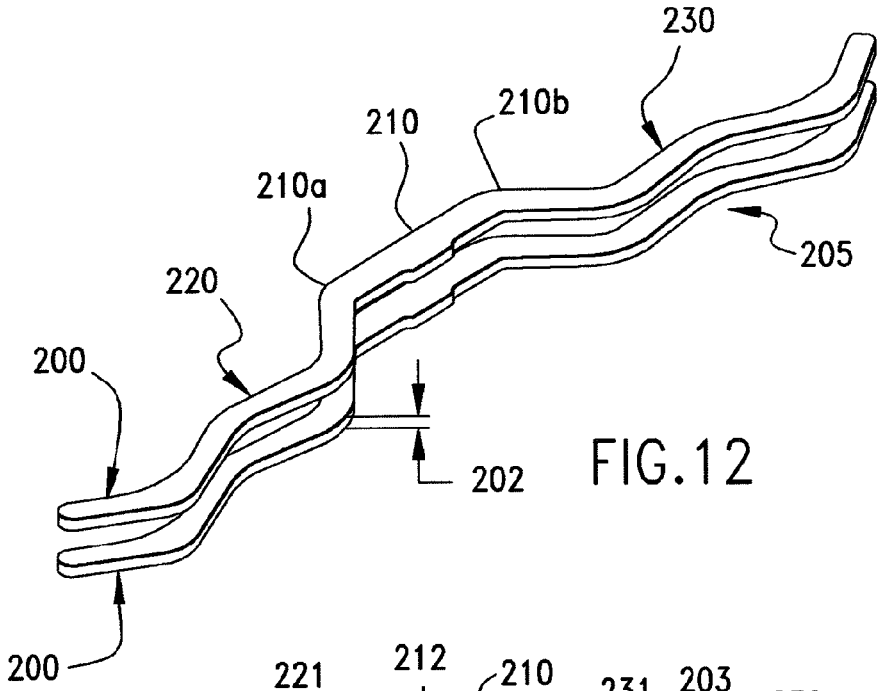
FIG. 12 is a perspective view of an exemplary embodiment of a signal pair.
Figure 13A:
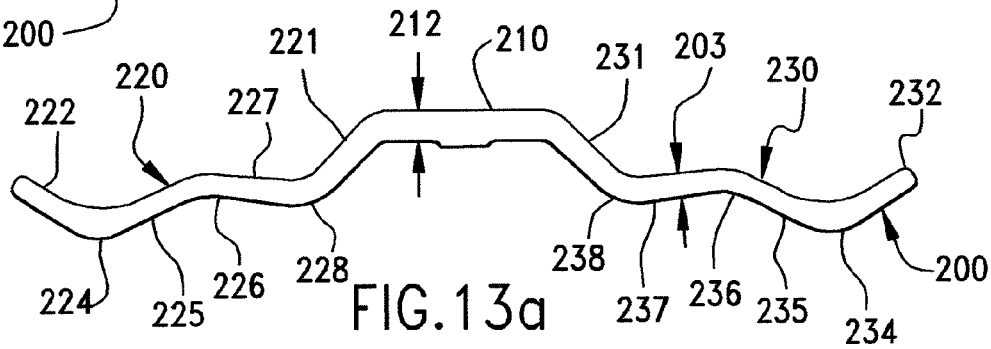
FIG. 13*a* is an elevational side view of a terminal depicted in FIG. 12.
Figure 13B:
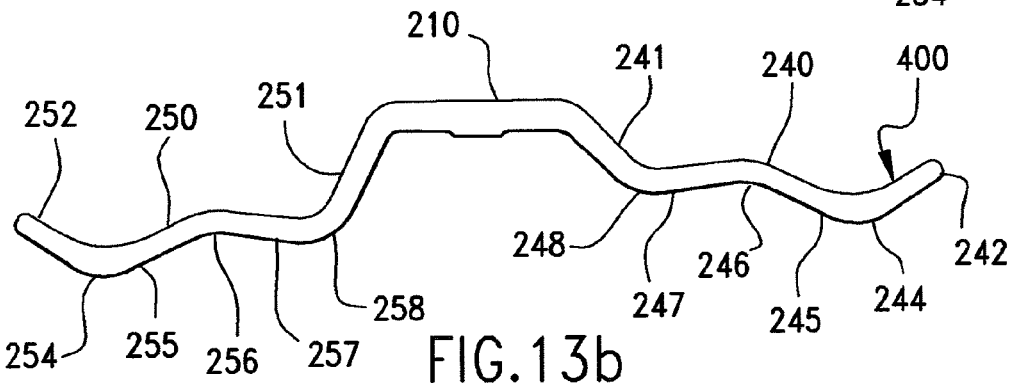
FIG. 13*b* is an elevational side view of an embodiment of a terminal configured for coupling two panels of different thicknesses.

Turning to FIGS. 12-13*b*, details of exemplary embodiments of the signal pair 205 are illustrated. As depicted, the signal pair 205 includes two terminals 200 that are broadside coupled and each terminal includes a body 210 with a width 212 and a thickness 202. In an embodiment, the thickness is maintained in both leg 220 and leg 230. In an embodiment, the cross-section of the terminal 200 may be kept substantially constant along its length and variations in cross-section can be minimized so as to avoid features changes that have a dimension greater than a predetermined percentage (such as the wave length $\lambda$ divided by twelve or $\lambda/12$) of the relevant frequency wherein $\lambda$ is based on the relevant frequency associated with the desired data rate). More regarding feature granularity will be discussed below. The terminal 200 is configured to handle the deflection needed to account for panel thickness variation and leg 220 includes a contact portion 224 (from which tip 222 extends) that is coupled to body 210 via first section 221. It should be noted that the tip may extend more than the predetermined percentage but other features, such as modifying the distance to the ground plane in the circuit board or adjusting the regional permittivity, can be used to address this issue to a certain degree. The leg 220 further includes a first arm 225, a first bend 256, a second arm 257 and a second bend 258 that couple the contact portion to the first section 221. The leg 230 similarly includes a contact portion 234 coupled to first section 231 by first arm 235, first bend 236, second arm 237 and second bend 238.

Regarding the general desire to minimize variations in feature size in the terminal, it should be noted that the use of variations can be helpful to vary the capacitance between a signal pair so as to reach an overall desired impedance level with the terminal. Therefore, for a terminal with a given width (due to the desired pitch, for example) it may be beneficial for certain speeds to add material (e.g., vary the height of a fixed width terminal) to increase the capacitance of a region of the terminal so as to ensure the entire terminal has the desired impedance (e.g., increase capacitance to decrease the total impendence of the terminal). Such variations, however, introduce an impedance discontinuity within the terminal. Each such discontinuity can be equated to a filter with respect to the signal being transmitted through the terminal because the discontinuity will create some return loss.

As the return loss increases, the signal level decreases and eventually will reach a point where the signal cannot be distinguished from the noise otherwise present in the system. Furthermore, simply increasing the signal power does not help much as return loss is a measure of reflected power. In addition, return loss for a particular impedance discontinuity tends to increase as the frequency increases. Therefore, the return loss generally increases as the frequency increases. Thus, if the return loss value falls within an acceptable range at the highest frequencies, it can be expected to be okay at lower frequencies as well.

It has been determined that for a given level of performance (e.g., desired data rate) there is a budget of impedance discontinuity in a terminal that is permissible before the terminal ceases to perform in a desirable manner due a unacceptable return loss. In other words, a terminal will have a root current path that provides the overall impendence level desired by the system (e.g., 100 or 85 ohms). If the terminal is a constant width (as is common for a number of terminal designs), the root current path will define a height associated with the root current path. Each deviation in the height of the terminal from the height associated with the root current path can create an impedance discontinuity that will increase the return loss (thus acting filter-like) and the effects can be additive over the length of the terminal. For a typical application, therefore, the desired data rate will be associated with the maximum amount of height deviation that is permissible before the return loss exceeds a predetermined db level. The budget for terminal height deviation when being used for non return to zero (NRZ) signaling can be provided by the equation:

$\lambda_m=(RL_f)(1/Dr)(C)(1/SQRT(\in_{eff}))$ where $\lambda_m$ is the length associated with the permissible sum of feature size deviations for a frequency required by the desired data rate; $RL_f$ (return loss factor) is about 1/9 for about a −10 to −12 db return loss level and is about 1/12 for about a −15 to −17 db return loss level and is about 1/15 for a return loss of better than −20 db; Dr is the data rate in bps; C is the speed of light in a vacuum (3 E8); and $\in_{eff}$ is the effective regional permittivity of the connector.

For a constant width terminal such as depicted above, if a 10 Gbps data rate is desired, for example, then with a $\in_{eff}$ of about 2 and a $RL_f$ at 1/9 (for a desired −10 to −12 db of return loss performance), $\lambda_m$ becomes about 2.36 mm (e.g., there can be about 2.36 mm of height variation with the absolute value of the height change for each region being summed). At a 20 Gbps data rate, $\lambda_m$ becomes about 1.18 mm and at 30 Gbps, $\lambda_m$ becomes about 0.79 mm. It should be noted that, depending on system sensitivity (and/or manufacturing tolerances), using $RL_f$=1/9 may not provide a sufficient degree of system level tolerance and therefore a safer design choice may be to use $RL_f$=1/12. Using $RL_f$=1/12, $\lambda_m$ becomes about 1.77 mm for 10 Gbps, $\lambda_m$ becomes about 0.88 mm for 20 Gbps and $\lambda_m$ becomes about 0.59 mm for 30 Gbps.

To measure the acceptable deviation in a terminal, λ can be defined as the length associated with a wavelength of three halves (3/2) the required signal frequency in the terminal for the desired data rate for a particular connector (e.g., $\lambda=(1/((3/2)(1/2))Dr)(C)(1/SQRT(\in_{eff})))$. The 3/2 value is to account for the general desire that a terminal be functional up to 3/2 the Nyquist frequency and provides a beneficial safety factor (which may be removed or reduced if desired but such reduction may affect the manufacturability of the connector). It has been determined that by dividing the wavelength λ by 6 (λ/6), a region of the terminal can be defined such that changes within the region may be used to determine the height variation. In other words, λ/6 can be used to define the granularity of the terminal—it is this value that is associated with a $RL_f$=1/9. It should be noted that λ/8 could also be used to define the regional granularity (which equates to the $RL_f$ value of 1/12), and this will provide more (and smaller) regions per terminal length. Using λ/8 will provide greater return loss performance (it is expected to provide about a −15 to −17 db level rather than about a −10 to −12 db level return loss). Furthermore, if a greater return loss performance is desired, λ/10 could be used to define the regional granularity (equating to an $RL_f$ value of 1/15) so as to obtain somewhere in the neighborhood of about −20 db (or more) of return loss performance.

Regardless of the regional granularity/region size (and associated performance) chosen, half the regional granularity is equal to the value $\lambda_m$, which is the permissible deviation (as defined above), because the signal travels the length of the deviation and back. Feature variations can be determined within a region defined by the regional granularity (with positive and negative changes essentially cancelling each other out as long as the changes take place within the corresponding region). Once the variations in a region are summed, the absolute value of the sum of variation in each region can be summed to determine whether the total deviation is less than λ/12 for about −10 to −12 db of return lose (or λ/16 if return loss performance of about −15 to −17 db is desired). In an embodiment, the terminal may be configured so that for n regions, where the number of regions (n) is determined by the length of the terminal divided by the regional granularity (e.g., terminal length divided by (λ/6)), the regional size change Rs(n) (e.g., the variance in height within a region) is such that $\lambda/12>\Sigma|Rs(n)|$. In an alternative embodiment, the terminal may be configured so that for n regions the regional size change Rs(n) is such that $\lambda/16>\Sigma|Rs(n)|$. In an alternative embodiment, the terminal may be configured so that for n regions, the regional size change Rs(n) is such that $\lambda/20>\Sigma|Rs(n)|$.

As noted above, additions of material with respect to the root current path within a region can be used to cancel out subtractions of material in the same region with respect to the root current path. On the other hand, features that extend across more than one region may be counted twice. Thus, an extended bump that is more than one region long could count as two bumps, one for each region, to account for the full effect of the extended deviation. It should also be noted that because the regional boundaries are somewhat arbitrary, a feature appearing at a boundary of a region shouldn't be double counted unless the feature extends more than a distance defined by the region. In other words, if the changes in height are essentially balanced out within a distance associated with the chosen region, the deviations need not be included in the final total of deviations. Thus, modifying or correcting features (such as adjusting the regional permittivity reduction as discussed above) can be applied to a particular feature so that the effect of the variance can be diminished. Such corrections, however, generally should be contained within the defined region or they will fail to act as corrections and instead be seen as additional variances that affect the total allowed deviation.

As can be appreciated by the above discussion, increasing the data rate will decrease the size of the region and also decrease the permissible deviation. Therefore, features that substantially even out for a first frequency might act as individual deviations that must be included in the total amount of deviation at twice the frequency. Consequentially, increasing the data rate becomes more difficult because feature variations need to be kept smaller while the corrections need to be positioned closer or the features and corrections just become individual deviations counting against the total allowable amount of deviations. However, using the provided guidelines allows for the design of a connector that can meet the desired data rate goals while providing sufficient signal levels.

Figure 26:
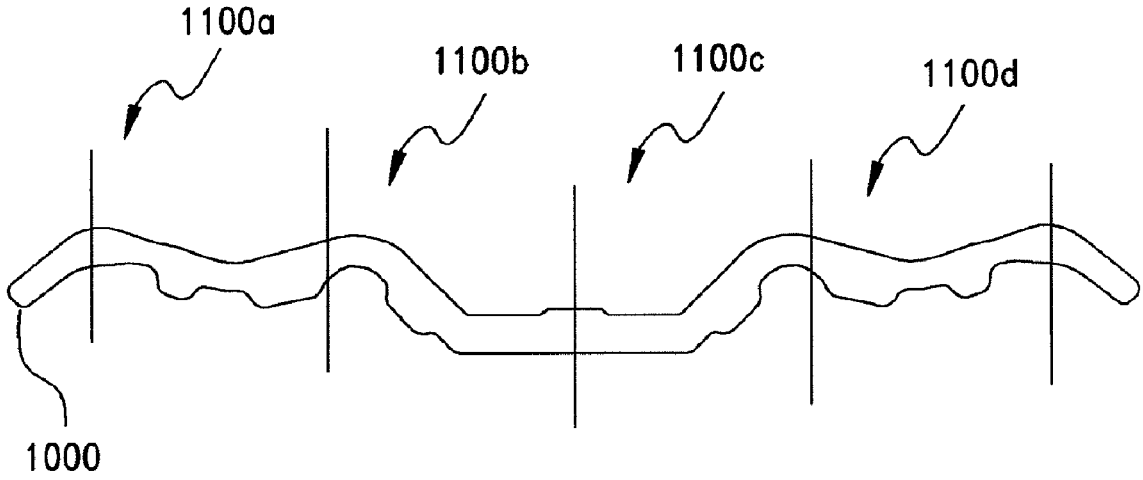
FIG. 26 illustrates an alternative embodiment of a terminal that may be used in a connector when desiring to provide 85 ohm impendence.

For example, looking at FIG. 26, a terminal 1000 design is provided that could be used for a system with 85 ohm impedance and the terminal 1000 includes a number of feature variations. If the connector length is such that the terminal 1000 includes 4 regions when divided by λ/6 or λ/8 (depending on the desired return loss performance), then the features within region 1100*a*, for example, can be used to average out the deviation in the region compared to the root current path. This average variation becomes Rs(1100*a*) and the absolute value of this deviation is added to the absolute value of deviations in the other regions 1100*b*-1100*d* to determine whether the total deviation is less than λ/12 (or λ/16 if λ/8 was used to determine the region size). As can be appreciated, however, if twice as fast a data rate is desired, the allowable amount of deviation will be cut in half, the number of regions will increase and sum of the amount of variation per region can be expected to be increased, potentially causing the total deviations to, as a percentage, more than double. In other words, deviations at 10 Gbps might be equal to 50 percent of the permissible deviation but at 20 Gbps might be equal to more than 100 percent of the permissible deviation.

FIG. 13*b* illustrates an embodiment of a terminal 400 for use in a connector that is configured to receive two panels with different thicknesses. The body 210 in both terminal 200 and 400 is the same, as are most of the other portions of the terminals 200, 400. Thus, as depicted, tip 242, contact portion 244, first arm 245, first bend 246, second arm 247, second bend 248 and first section 241 of leg 240 are the same as the respective features of leg 230. Similarly, tip 252, contact portion 254, first arm 255, first bend 256, second arm 257 of arm 250 are the same as the corresponding feature in arm 220. However, second bend 258 and first section 251 of leg 250 are different than the corresponding feature of leg 220 so as to account for dimensional difference in the panels that the terminals are configured to receive. While a similarity in leg configuration is not required, the similarity makes it easier to test and certify the suitability of a particular terminal for a particular application because most of the terminal is the same and just the second bend and the first section needs to be changed to account for different panel thicknesses.

Figure 14A:
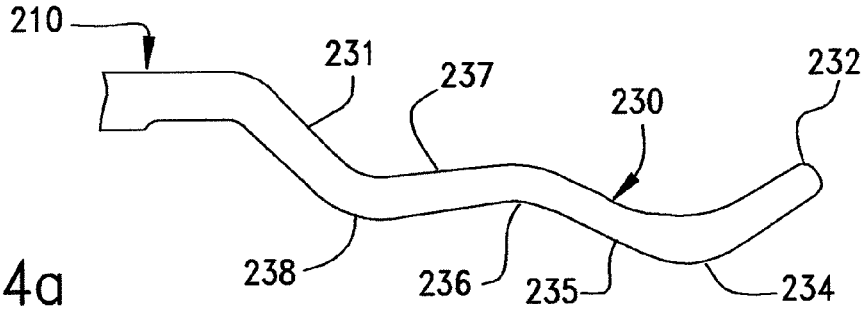
FIG. 14*a* is an elevational side view of an exemplary embodiment of a terminal leg.
Figure 14B:
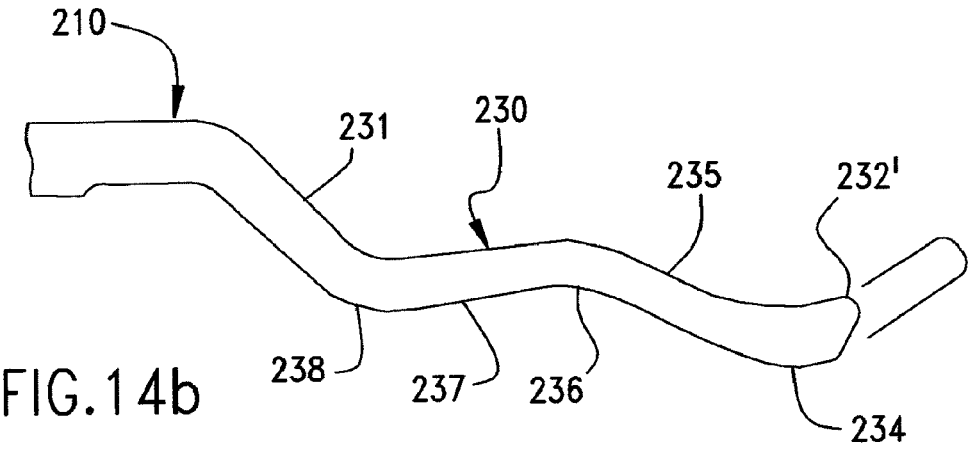
FIG. 14*b* is an elevational side view of an exemplary embodiment of a terminal leg with a modified tip.

FIGS. 14*a* and 14*b* illustrate two embodiments of a terminal leg 230. As can be appreciated, the design of the depicted terminals legs 230 both include the first section 231 extending from the body 210. Between the contact portion 234 and the first section, the first arm 235, the first bend 236, the second arm 237 and the second bend 238 are the same. However, FIG. 14*b* depicts a tip 232' that is truncated compared to tail 232. Tip 232 is used to ensure a proper and consistent mating with the signal traces on a panel. However, it has been determined that truncating the tip 232, while making the installation potentially more problematic mechanically, is beneficial in improving signal characteristics of the terminal and there can be used to provide a higher performance signal path. Thus, reducing the distance from the point of contact of the contact portion 234 to the tip 232' has the potential to provide significant performance enhancements as it decreases the impedance discontinuity and therefore reduces the return loss (effectively increasing the relative signal level). The side walls of the terminal groove can still act to restrain the terminal so as to help reduce deflection of the terminal in a direction transverse to the terminal groove 160.

Figure 15A:
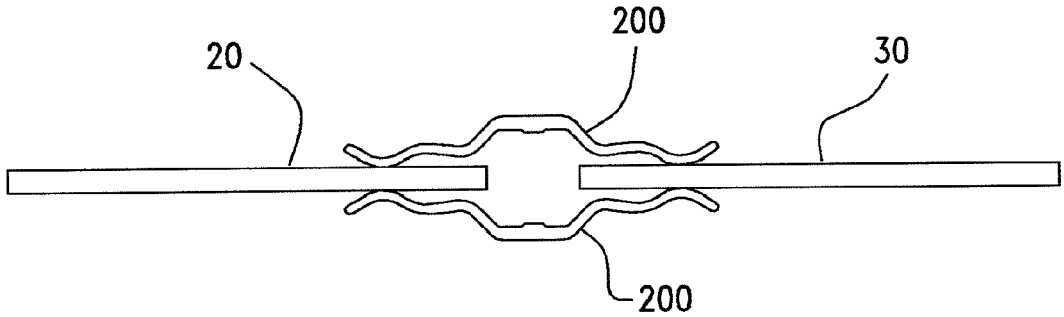
FIG. 15*a* is a simplified side view of two panels coupled on two sides by terminals.
Figure 15B:
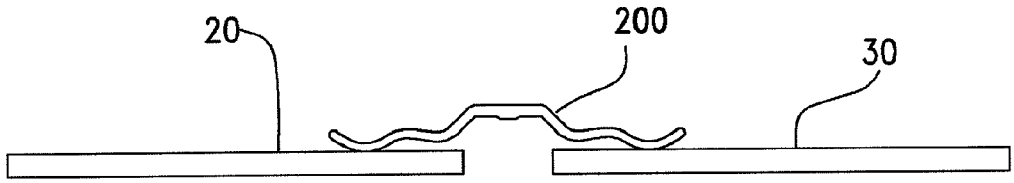
FIG. 15*b* is a simplified side elevational view of a two panels coupled on one side by a terminal.
Figure 15C:
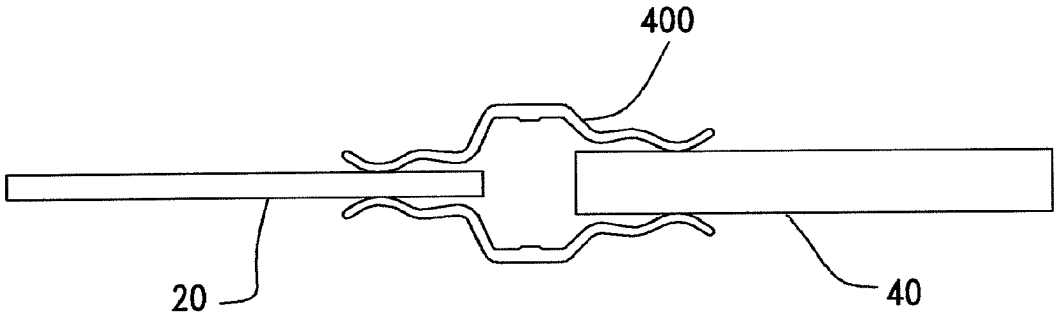
FIG. 15*c* is a simplified side elevational view of two panels with different thicknesses coupled on two sides by terminals.

FIGS. 15*a*-15*c* illustrate how the terminals coupled the signal paths on two panels. As can be appreciated, FIG. 15*b* illustrates a one-sided connection and FIG. 15*c* illustrates a two sided connection between two panels of different thicknesses. A one-sided connection between the two panels of different thicknesses is also contemplated. In an embodiment where there is a two-sided connection, the co-planar nature of the connector allows the same terminals to be used on both sides, thus allowing for consistent performance without the need to design a separate terminal for the second side. This has the potential of providing substantial costs savings in the connector design and can provide parties designing the panels with the flexibility to add additional signal paths within the same panel real estate as needed.

Figure 16:
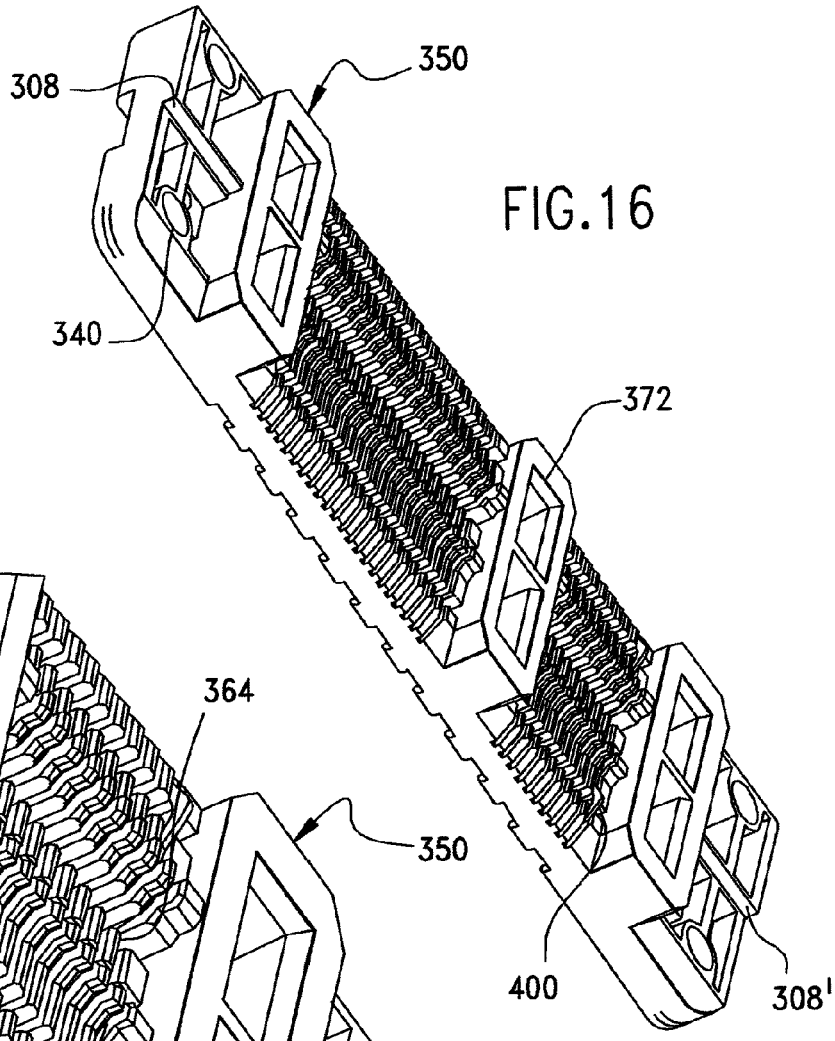
FIG. 16 is a perspective view of an exemplary embodiment of a housing with a terminal positioned in a terminal channel.
Figure 17:
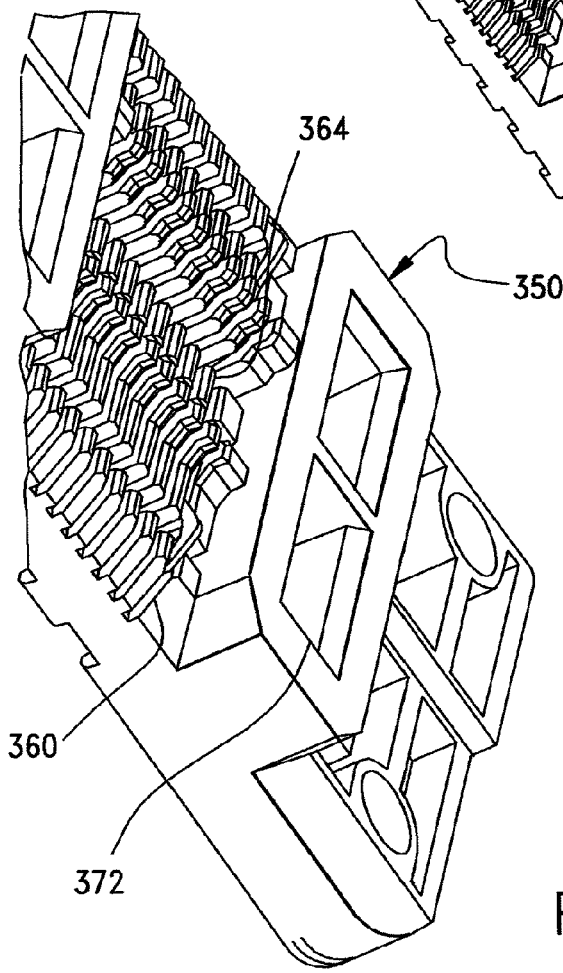
FIG. 17 is an enlarged view of the embodiment depicted in FIG. 16.

FIGS. 16 and 17 illustrate additional details of a housing 350 configured to couple to two panels of different thicknesses. While only one terminal 400 is illustrated as being positioned in a terminal channel 360 of housing 350, any number (limited by the number of terminal channels) may be supported by the housing 350 and staked into place with stake portion 364. As depicted, the housing 350 includes the shoulders 308, 308' for coupling the two different thickness panel channels that will be formed when the housing 350 is joined to a corresponding housing (the joining using coupling aperture 372). The depicted housing 350 also includes a locking feature, which is illustrated as connector aperture 340.

Figure 18A:
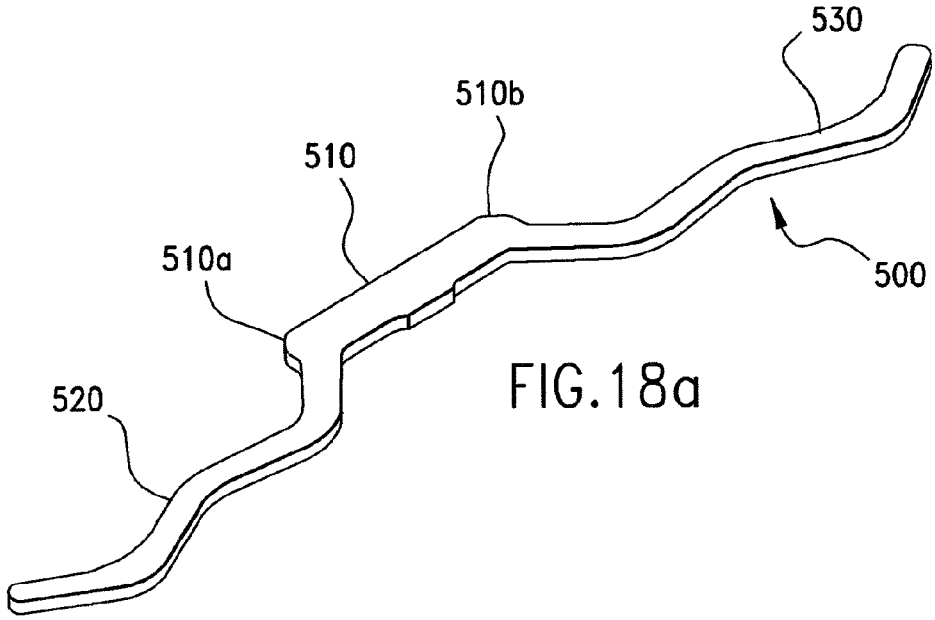
FIG. 18*a* is a perspective view of an exemplary embodiment of a terminal.
Figure 18B:
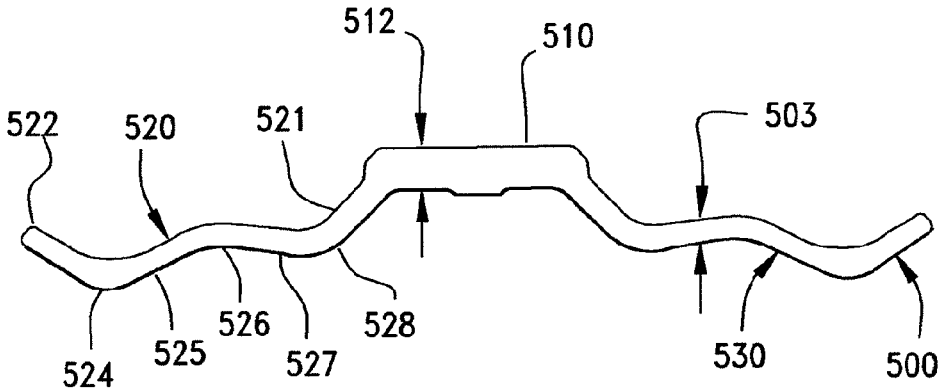
FIG. 18*b* is an elevational side view of the terminal depicted in FIG. 18*a*.
Figure 19A:
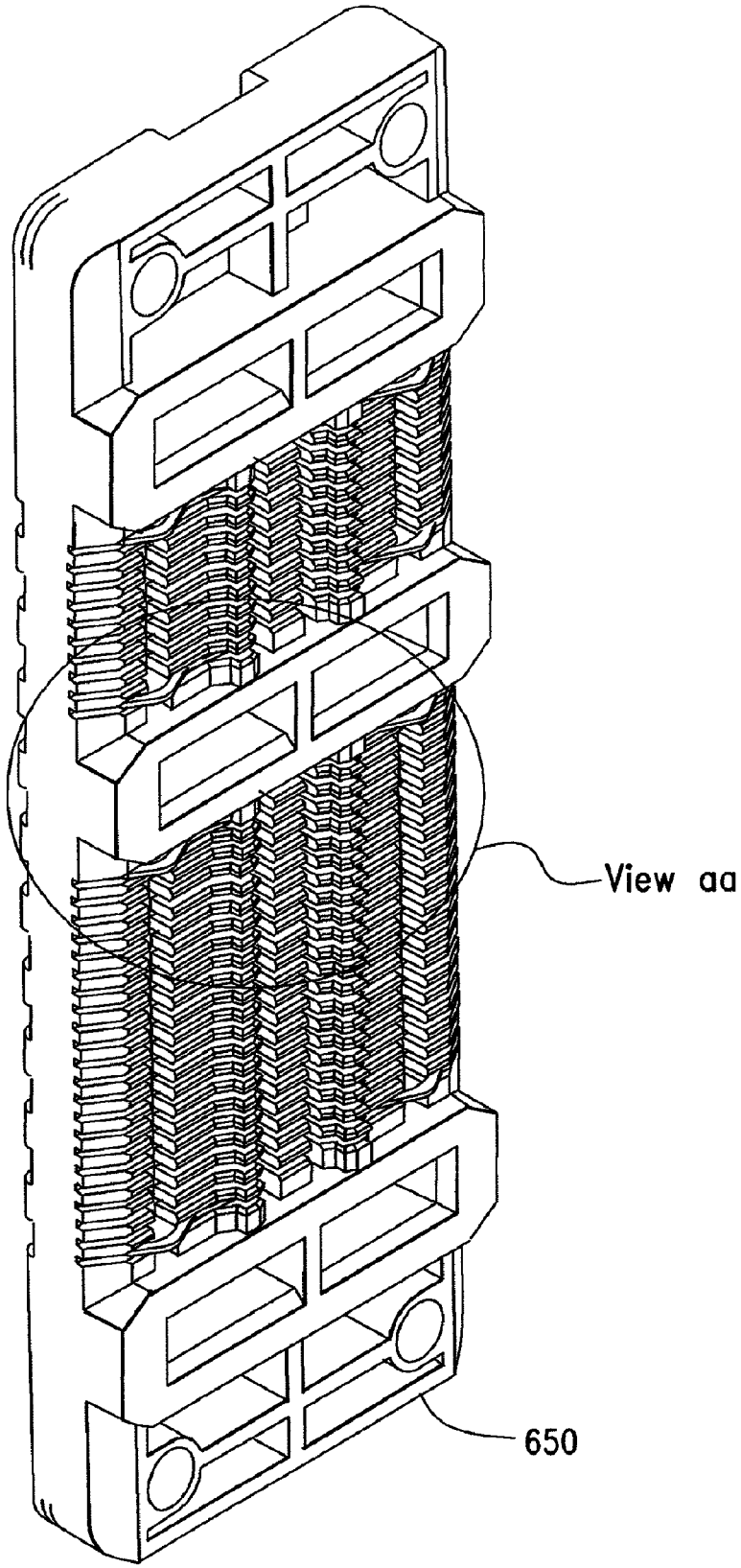
FIG. 19*a* is a perspective view of an exemplary embodiment of a housing with a terminal positioned in a terminal channel.
Figure 20A:
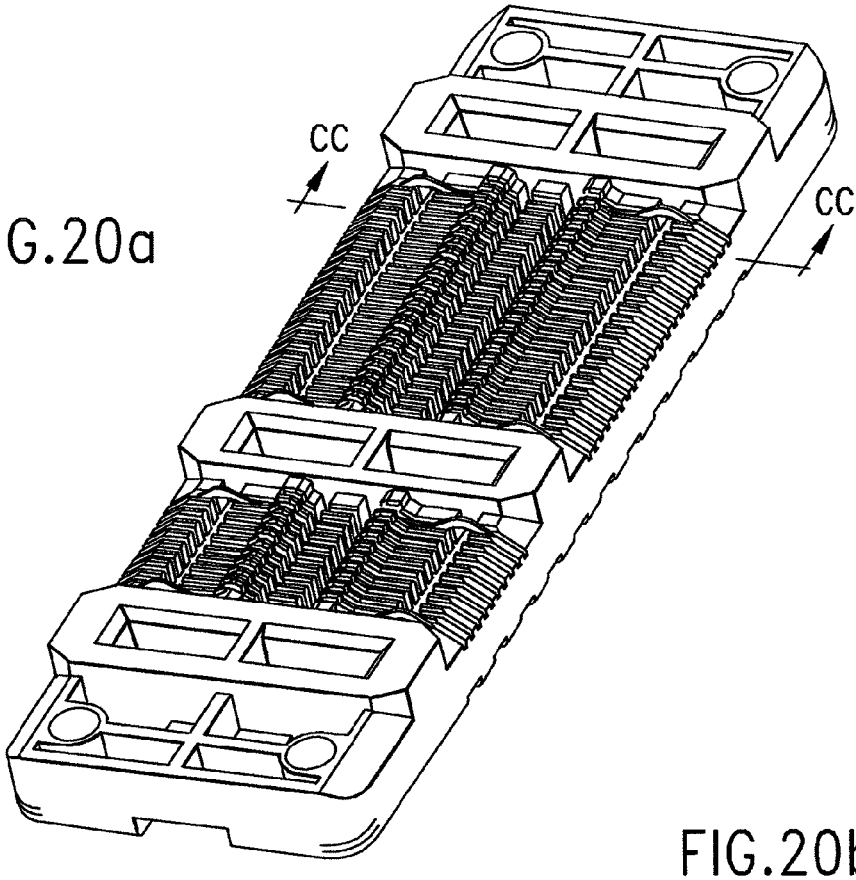
FIG. 20*a* is a perspective view of an exemplary embodiment of a housing with a terminal positioned in a terminal channel.
Figure 20B:
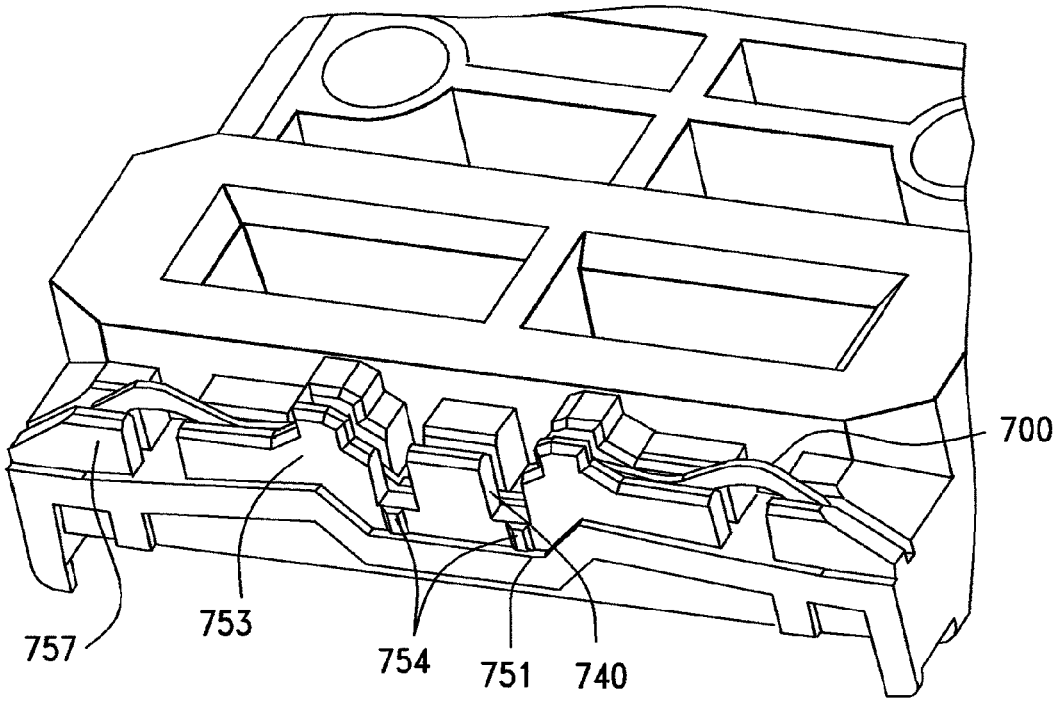
FIG. 20*b* is an enlarged partial cross-section view along the line cc of the embodiment depicted in FIG. 20*a*.

As can be appreciated, the terminals can be configured to provide a particular impedance level, such as 100 ohms. It is also possible to provide a modified version of the terminal that is suitable for a different impedance level such as 85 ohms. The alternate 85 ohm impedance can be achieved with different levels of granularity to provide an appropriate response in systems with different signaling speeds. FIGS. 18*a* and 18*b* illustrate an exemplary embodiment of a modified terminal that maintains critical mechanical spring sections with increased capacitance only through the fixed section of the terminal. This type of terminal, because of the significant change in feature size between the body 510 and the leg 520, 530, would exhibit a rougher granularity and be likely limited to speeds typically below about 12 Gbps. A design that reduced the size of the body 510 and added additional features in other places on the terminal so as to provide the desired overall impedance could potentially be used at higher speeds if the increase in the number of changes in feature size was sufficiently offset by a decrease in the change in size of the features. While a single terminal is shown for illustration purposes, a signal pair may be composed of a broad-side coupled pair of terminals, as discussed above.

In an embodiment, leg 520 is the same shape as the leg 220. Thus, a first section 521 through tip 522, including contact portion 524, first arm 525, first bend 526, second arm 527 and second bend 528 are the same as the corresponding features of leg 220. However, a width 512 of body 510 is different than the width 212 of body 210. The additional width drops the impedance of the body section down to the desired 85 ohms. To address the impedance of the leg section, the capacitance of the signal traces on the panel may be increased (such as through material properties of the panel or changes in the distance of the signal trace to a ground plane). It is noted that while changing the impedance of the body section tends to be detrimental to overall performance of the signal pair, increasing capacitance of the signal traces tends to negate a portion of the effect causes by the change in impedance in the body and thus a majority of the desired performance may be maintained. Thus, a connector configured to meet a first performance goal at 100 ohms impedance may be readily modified to meet a second performance goal at 85 ohms with only minor performance reductions (by increasing the height in selected locations, for example). In addition, if the connector has sufficient performance headroom at 100 ohms, the modified connector can readily meet the same performance goals at 85 ohms without the need to redesign the entire terminal. In another embodiment of a terminal design, the capacitive loading and thereby impedance discontinuities may be more evenly distributed across the entire length of the terminal so as to reduce the granularity of the loading features, thereby increasing terminal smoothness and effective upper signaling speed.

FIGS. 19*a*-20*b* illustrate additional features that may be used to secure a terminal in a terminal channel. In particular, terminal channel 750 includes a floor 751 that extends substantially along the terminal channel 750. The terminal 700 may be positioned in the terminal channel 750 so that it is supported by the floor 751. As depicted, first side wall 753 and second side wall 757 provide a portion of the structure that forms the terminal channel 750. To further secure the terminal 750 in position, side wall projections 754 and 755 extend into the terminal channel 750 on both sides of a stake portion 740. The benefit of this configuration is that the terminal may be maintained in position in a relatively secure manner next to side wall 741 of stake portion 740 until the stake portion 740 can be staked so as to hold the terminal 700 in place. As shown, there are two side wall projections 754 and two side wall projections 755 that oppose each other and provide a friction fit use to hold the terminal in position until it is staked into place. Some other number of side wall projections may be used. For example, a side wall projection on one side may be used, although such a configuration would bias the position of the terminal in the terminal channel 750. Thus, a benefit of the depicted configuration is the ability to minimize biasing the terminal toward a side of the channel.

Thus, FIGS. 19*a*-20*b* illustrate features that may be used to secure terminals in a connector housing. It should be noted that other methods of securing the terminal in place can also be used. For example, a terminal position assurance method may be used. In an embodiment, not shown, an insert could be used to engage and secure the body of the terminal to the housing. In another embodiment, the terminals may be positioned in one or more frames so as to form one or more wafers that are mounted to the housing. Thus, a number of possible methods of mounting terminals to a housing exist and may be used. Accordingly, unless otherwise noted, this disclosure is not intended to be limiting in this respect.

Figure 22:
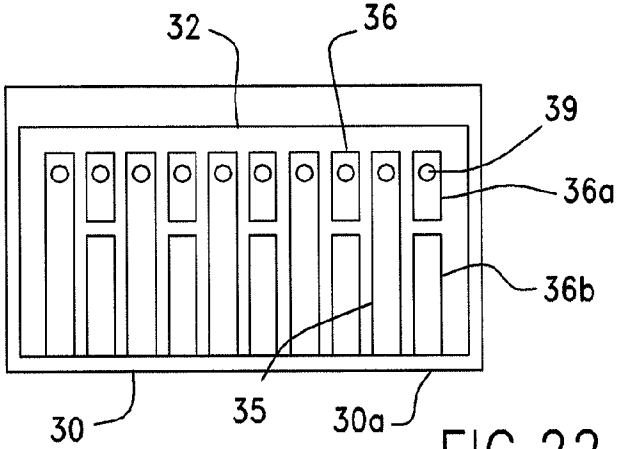
FIG. 22 is a schematic of an exemplary embodiment of a panel suitable for use in a singled-ended communication system.
Figure 23:
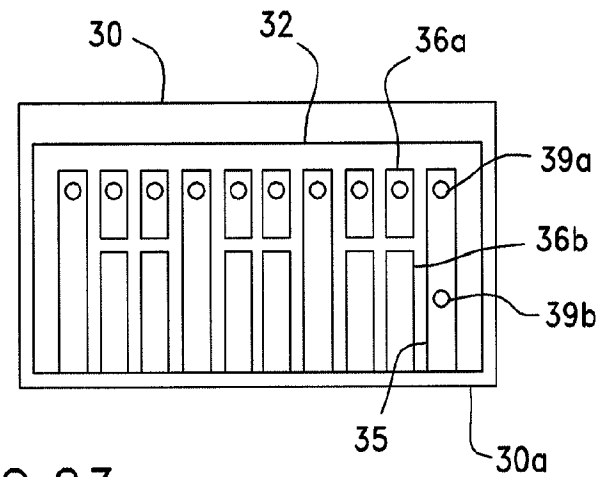
FIG. 23 is a schematic of an exemplary embodiment of a panel suitable for use in a differential signal communication system.

It should be noted that various features discussed above may be used in combination to provide the desired functionality. Providing increasing levels of performance is more difficult as the desired level increase and therefore obtaining great performance levels may require more or all of the features disclosed herein to meet the higher performance levels. It should be noted that the connector is part of a system that includes two panels. As can be appreciated, a poor panel design will prevent even a well designed connector from achieving high performance levels at a system level. Thus, the following discussion of performance levels presumes the use of a split-pad structure using via-in-pads technology, as illustrated in FIGS. 22 and 23 and discussed below. Naturally, improvements to the connector can be used to offset a poorer performing panel and therefore, the following linking of performance and terminal design does not address all such possibilities but is instead provided so as to allow a person of skill in the art to appreciate a system that can provide the disclosed performance levels. In other words, a suitably designed connector would be configured to provide the desired level of performance even if the connector was ultimately used in a system that did not allow the actual through-put to reach the following performance levels.

For example, the depicted design of the terminals in FIG. 12 with the substantially consistent cross section illustrated in FIG. 13*a* along the length of the terminals, or with some other configuration that allows a relationship such as $\lambda/6>\Sigma|Rs(n)\uparrow$ (as discussed above) in combination with the use of broadside coupling to form a differential pair configuration can provide a connector suitable for the desired data rate performance level. As can be appreciated, the size of the tail has a significant impact on the deviation within a region, therefore the use of the regional dielectric variance may be sufficient to increase the performance of differential signal pairs to a greater than 15 Gbps performance level. In particular, such a connector can provide at least 17 Gbps, which maybe required for future signaling standards. It should be noted that higher levels of performance are possible as the tolerance of the form of the terminals and position of adjacent terminals used as a signal pair are more closely matched. In addition, the use of truncated tails can provide further performance improvements, most notably improved return loss, raising the performance level to 25 Gbps or higher.

In this regard, a truncated terminal design that exhibit finer electrical granularity and that have a tail that extends only a little beyond the contact point have been determined capable of reaching relatively high performance levels. A terminal with a 1.2 mm tail extension, for example, may be capable of reaching 15-20 Gbps performance levels with the use of regional dielectric variance. However, a terminal with a 0.8 mm tail extension (the impedance discontinuity can be offset by the regional dielectric variance) and with otherwise relatively constant height may be suitable for reaching levels of 20-30 Gbps or more. It should be noted that as the desired performance level increases, the design of the panel must be configured so as to be compatible with the desired performance level. Otherwise the connector will be configured to provide the desired level of performance but the system will be much more limited in performance.

Accordingly, the illustrated designs of the connector allows for embodiments of the connector to be easily slide into place on the edge of two panels, even panels with different thicknesses. Certain embodiments therefore provide for greater flexibility, ease of use and performance than currently available from co-edge connectors.

It should be noted that in an embodiment the connector can have a low profile so as to minimize resistance to air flow across the connected panels. For example, in an embodiment the connector may extend about 3.2 to about 4.9 mm off the panel. If the connector is fastened to the panel with a rivet or some other low profile fastening system, this offset can be the total offset (thus providing a relatively low profile). Other fasteners may also be to secure the connector to the panel, if desired. It should be noted that in an embodiment, the edges of the connector may be tapered so as to further reduce air flow. Thus, certain embodiments may be well suited to functioning in high-performance environments where air flow over the connector is important to ensure the system is properly cooled.

The co-edge connectors discussed above are suitable for providing sufficient performance between two co-planar panels. Certain embodiments of the edge connector, however, may be configured to provide an angled connector. Such a connector could still mount to the edges of two different panels; the difference would be that the panels would be configured at some angle to each other, such as 90 degrees. Thus the terminals would need to be configured to provide the desired angle. This can be accomplished by varying the length and/or direction of the bends that make up the terminal. For example, looking back at FIG. 13*a*, the arm 221 could extend at the same angle to the body 210 but be directed up instead of down and the length of bend 258 could be increased to provide for a 90 degree connector. However, terminals on the same side of the connector could still be matched and aligned to adjacent terminals as previously discussed.

Figure 21:
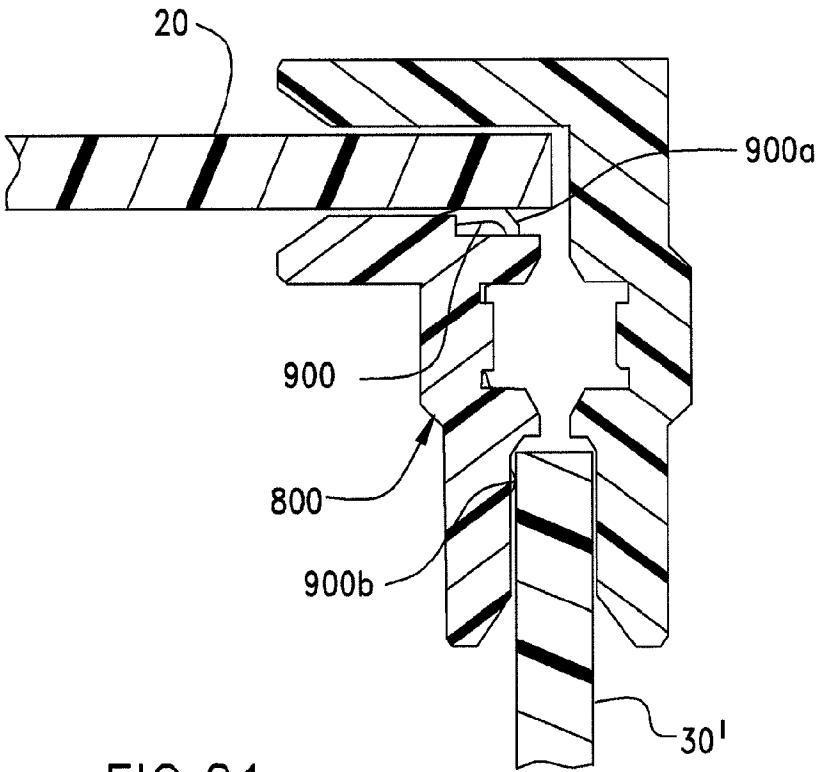
FIG. 21 is a cross-section view of an exemplary embodiment of a right-angle connector.

For example, FIG. 21 illustrates an angled connector 800 configured to coupled the edges of panel 20 with panel 30' together. While the connector 800 may be one or two-sided, one difference from the co-planar design is that in a two-sided angled connector, the two terminals on both sides of the connector traces cannot physically be the same between the signal traces. For example, the terminals 900 in FIG. 21 are not the same as the terminals 901 because the terminals 900 have a shorter path to travel as compared to the terminals 901. It is expected that the terminals with the longer path, assuming that there is a terminal with a longer path, will be the limiting factor if the same speeds are attempted to be used on both sides of the connector. Use of this type of connector is contemplated in system use where the associated signaling electronics are robust with respect to skew differences appearing between channels. In particular, since the individual signaling channels are broadside coupled and wholly contained on either the long or short path length, each individual channel is inherently skew balanced. Thereby within-channel skew is always minimized by design. In addition, different speeds may be used on each side of the connector. Also, each side may be used for different purposes. For example, one side could provide lower performance data communication in combination with providing power while the other side could provide high-performance data communication.

As noted above, the performance and design of the panels will have an impact on how well the connector performs at a system level, even if the panel design does not necessarily affect the actual configuration of the connector. In an embodiment, the panel may be configured as illustrated in FIG. 22*a*, 22*b* or 23*a*, 23*b*. As can be appreciated, FIGS. 22*a*, 22*b* relates to a schematic of an exemplary embodiment of a panel 900*a* configured to communicate via a single-ended signal pair while FIGS. 23*a*, 23*b* illustrates a schematic of a panel 900*b* configured to communicate via a differential signal pair.

Figure 22A:
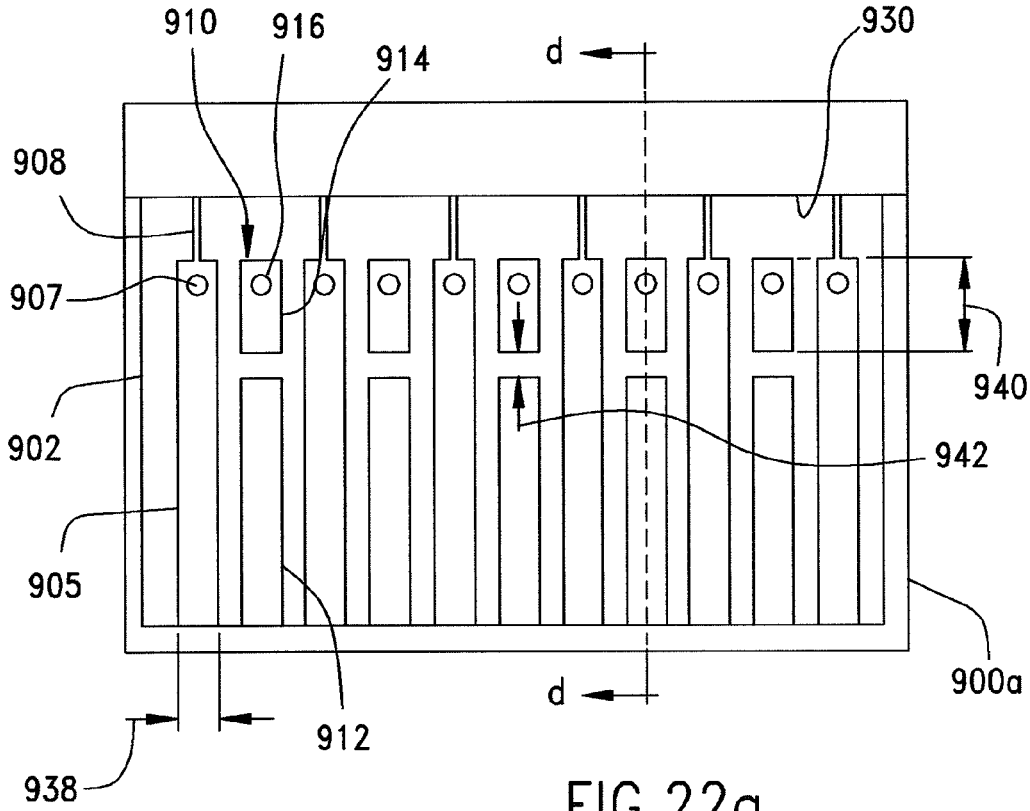
FIG. 22*a* is a schematic of an exemplary embodiment of a panel suitable for use in a singled-ended communication system.
Figure 22B:
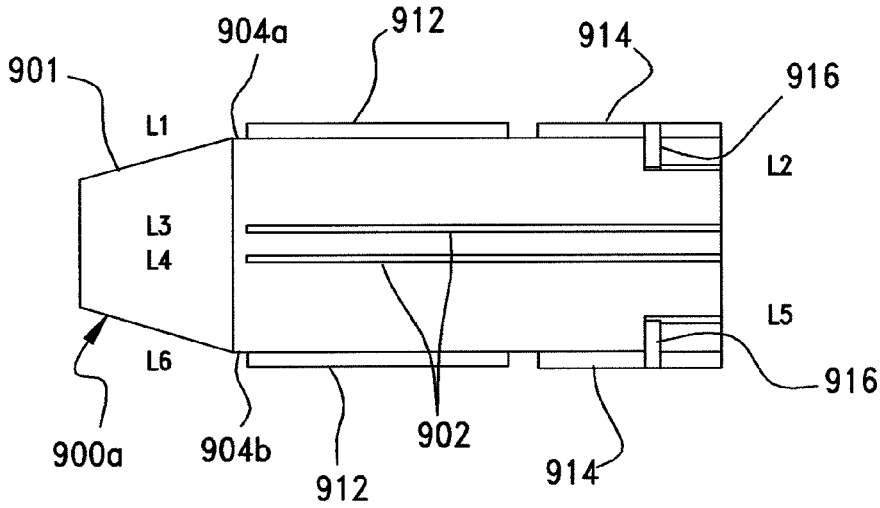
FIG. 22*b* is a schematic of a cross sectional of the embodiment depicted in FIG. 22*a* taken along line dd.
Figure 23A:
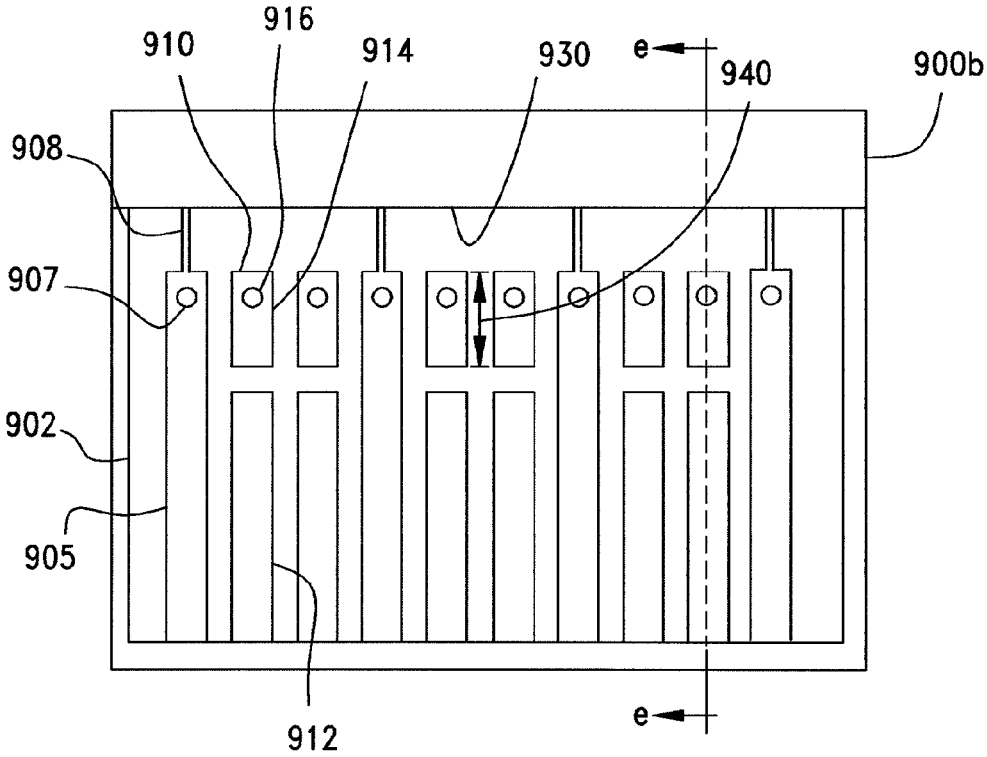
FIG. 23*a* is a schematic of an exemplary embodiment of a panel suitable for use in a differential signal communication system.
Figure 23B:
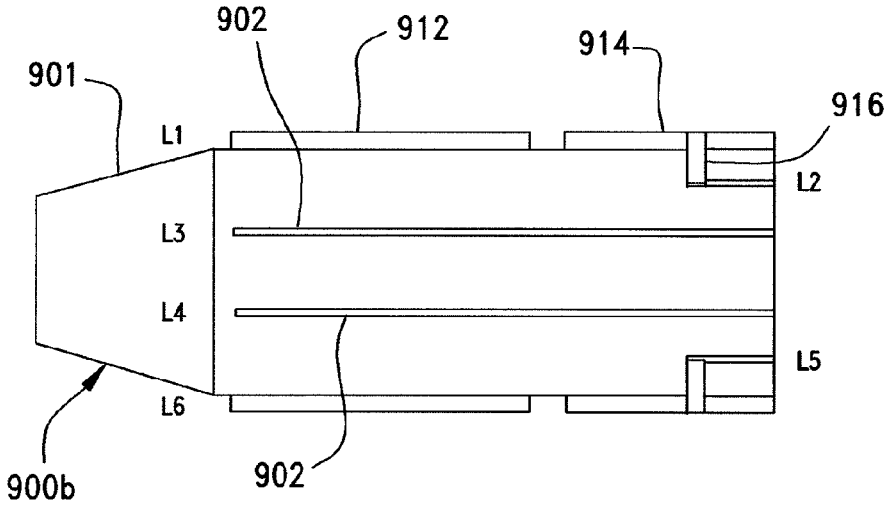
FIG. 23*b* is a schematic of a cross sectional of the embodiment depicted in FIG. 23*a* taken along line ee.

Looking first at FIGS. 22*a*, 22*b*, an embodiment of a circuit board (which is an example of a panel) suitable for use with a single-ended system is depicted. The panel 900*a* includes a ramp 901 that leads to surface 904*a* that supports pads that make up a first layer L1. In this regard, it is generally known that circuit boards are preferably constructed so as to be symmetric about a center access so as to minimize warping of the circuit board. Thus, for an application where the panel is a circuit board, it may be useful to have a symmetrical design. Therefore, the features on surface 904*a* may be duplicated on surface 904*b*. Similar construction may also be used on the other circuit board designs depicted in FIGS. 23*a*-25. As can be appreciated, certain features of the disclosed connector are well suited to take advantage of this symmetry.

The panel 900*a* includes a pad pattern with a ground pad 905 and then a signal pad 910. This pattern is repeated and then an additional ground pad may be added. Thus, the depicted signal pads 910 are surrounded by ground pads 905.

The ground pad 905 includes a via 907 located in the pad 905 (this configuration is known as via-in-pad) that extends between the L1 layer (where the pad resides) to a L3 layer where a ground plane 902 is located. The ground pad 905 further includes a trace 908 that extends from the ground pad 905 to a surface ground plane 930 (also on the L1 layer).

The signal pad 910 is a split-pad design and includes a lead portion 912 and a contact portion 914 with a dimension 940, the two portions separated by a gap 942 that may be a distance of about 0.2 mm. In a design that does not include the split-pad design, the capacitance between the signal pad and the ground plane would tend to decrease impedance to an undesirable level. Therefore, the ground plane 902 is typically configured so that it does not extend to the end of the pads. This unshielded area, however, allows for increase cross talk. The split-pad design of the signal pad 910, however, reduces capacitance. Thus, the ground plane 902 extends to the edge of the pads and therefore can help reduce cross-talk.

The via-in-pad design also improves performance. Outboard vias, which are commonly used in conjunction with signal pads, typically are coupled to the pad via a single trace. Such outboard vias have been determined to have greater interface inductance when compared to via-in-pad designs. This aspect is further complicated by the trace between the pad and via, which increases path inductance. Thus, response bandwidth is comparatively reduced in a panel where the via is outboard of the signal pad.

FIGS. 23*a*, 23*b* illustrate a panel 900*b* with a construction similar to the construction in panel 900*a*, except that the pads are arranged in a ground, signal, signal, ground pattern. Such a pattern is typically used in a differential signal pair configuration and often will be configured to provide desired impedance. The impedance value, however, can be modified by moving the ground plane 902 closer to the pads. Thus, a similar design with variations in the distance between L1 and L3 can be used to provide variations in the impedance.

The designs of the panels depicted in FIGS. 23*a*-23*b* are circuit board configurations that use known best practices and should provide a panel suitable for use with a connector as depicted herein so as to provide a system that offers high speed communication. As can be appreciated, the depicted co-edge connectors do not require such a panel design and will still help improve the performance of a system that uses an alternative construction of a panel. The total system performance, however, may be less if the panel configuration that is not sufficiently optimized is used.

As noted above, improvements to the connector are possible so as to reach performance levels of 20 to 30 Gbps with a panel configured as the circuit board depicted in FIG. 23, depending on the terminal tail stub lengths and other factors discussed above. At a system level, however, further performance may also be available. To provide this additional performance, certain modifications to the panel design may be beneficial.

Figure 24:
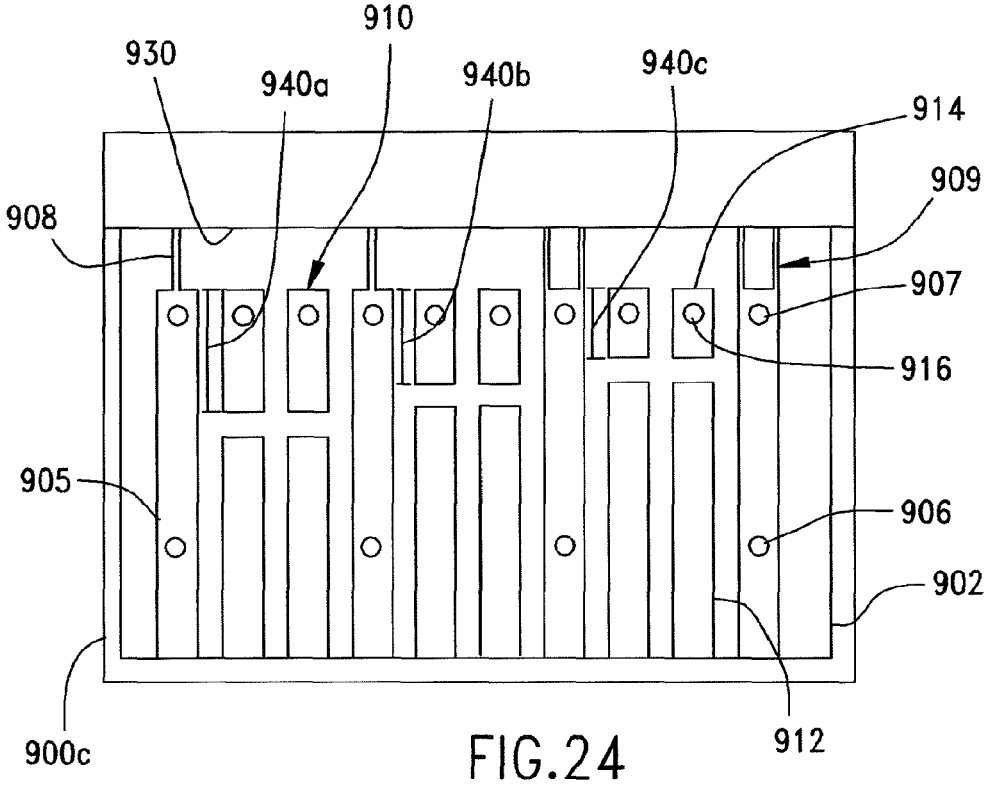
FIG. 24 is a schematic of an exemplary embodiment of a panel showing features that may be used to increase performance of a differential signal communication system.

For example, looking at FIG. 24, a number of features are disclosed that may be used, alone or in combination, to improve the system performance. First, looking at the split-pad signal pad design, the signal pad dimension 940 of contact portion 914 may be reduced from dimension 940*a* (which may be 1.6 mm) to 940*b* (which may be 1.2 mm) to 940*c* (which may be 0.9 mm). As can be appreciated, reducing dimension 940 provides a smaller target for the terminal 200 during installation, and thus is more difficult to use from a tolerance standpoint. However, it has been determined that such reductions have a significant improvement in performance and therefore for system where high speed is desirable, such a configuration is beneficial. Furthermore, a dimension 940 of about 0.9 mm is believed to be maintainable without significant redesign of the mating interface between the connector and the panels.

In addition, it has been determined that an additional via-in-pad 906 in the ground pad 905 can be used to further improve the ground structure and reduce resonance. In addition, to reduce inductance, trace 908 may be replaced with a dual trace 909. Thus, a ground, signal, signal, ground panel configuration can be enhanced by modifying the signal pad 910 with a reduced size contact portion 914. Similarly, the performance of the ground pad 905 can be enhanced with the use of the double trace 909 between ground plane 930 and pad 905 and with the use of the secondary via-in-pad 906.

Figure 25:
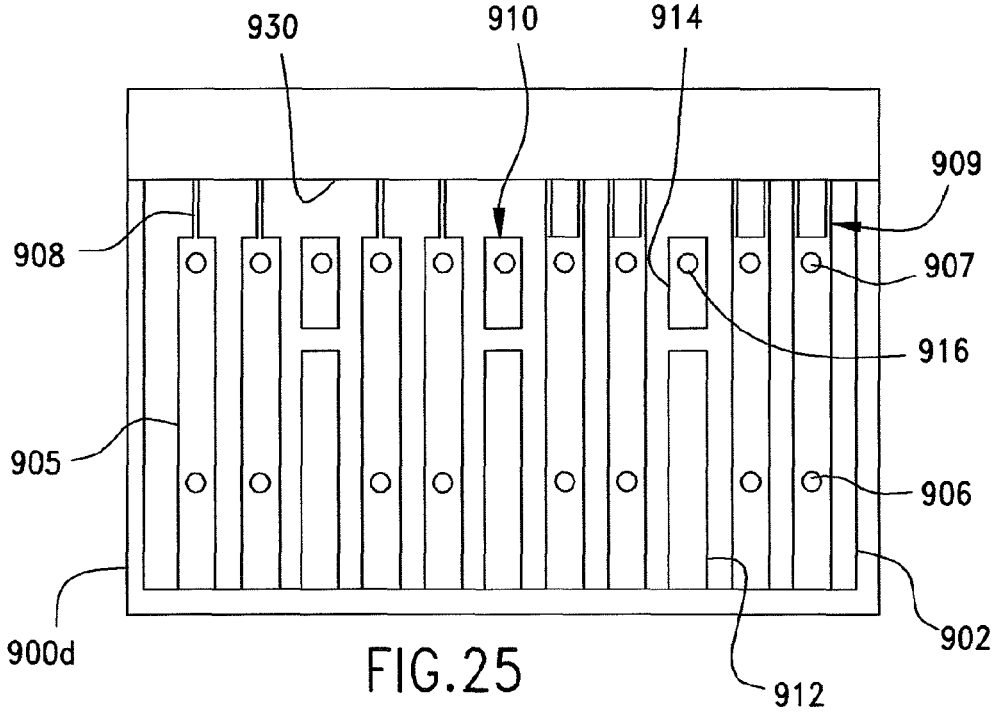
FIG. 25 is a schematic of an exemplary embodiment of a panel showing features that may be used to increase performance of a single-ended signal communication system.

It should be further noted that other variations in the pad structure may be used as desired. For example, a single-ended system might have a ground, ground, signal, ground, ground repeating pattern (as illustrated in FIG. 25) to help isolate the signals terminals from each other. The ground pads could further include the secondary via 906, as well as the dual trace 909. As can be appreciated, such a panel could provide significant performance from a single-ended system in the event such a communication configuration was desired.

In addition, a panel could be configured for a differential signal pairs that provided a signal, signal, space, signal, signal pattern instead of a ground, signal, signal, ground pattern.

It should be noted that while single-sided and two-sided connectors have been disclosed herein, a two-sided connector may be used on a panel that includes traces on a single side. In practice, the terminals on the second side can act as a compliant member and urge the inserted panel into a desired position relative to the housing of the connector. In an alternative embodiment, the connector may be single sided and the dimensional tolerance in the panel thickness can be addressed by the terminals on the single side. For example, the depicted terminal 200 with the two bends 226, 228 between the first section 221 and the contact portion 224 is suitable for handling the variation in panel thickness while ensuring adequate seating of the terminal with the signal traces on the panel, even if the connector only includes terminals on a single side. As can be appreciated, however, the terminal 200 would preferably be mounted in the terminal groove 160 differently (the floor could be raised at the point where the terminal was seated) or the opposite side of the connector could be modified to account for the absence of the other terminals. In another alternative embodiment, a biasing member other than terminals may be used to help position the connector and panel edge relative to each other. For example, compliant plastic members supported by the housing may be suitable for certain applications. A benefit of using a connector with terminals on both sides, however, is the ability to reduce the amount of panel spaced needed to communicate at the desired data rate, assuming the panel has contacts on both sides.

It will be understood that there are numerous modifications and combinations of the embodiments described above which will be readily apparent to one skilled in the art, including combinations of elements disclosed separately, as well as modification to the shape of various components. These modifications and/or combinations fall within the art to which this invention relates and are intended to be within the scope of the claims, which follow. It is further noted that the use of a singular element in a claim is intended to cover one or more of such an element.

The invention claimed is:

1. A co-edge connector, comprising:

a first housing with a first side, a second side, a third side, a fourth side, a first face and a second face, the first housing including a plurality of channels positioned on the first face and extending a portion of the distance between the first side and the second side, two adjacent channels including a notch adjacent to the first side and positioned between the two adjacent channels;

a second housing with a third face and a fourth face, the second housing configured to mate with the first housing so that the third face opposes the first face; and two terminals positioned in the plurality of channels and configured to be a broadside differential coupled signal pair, each terminal including a body portion and a first leg and a second leg, the first and second leg extending from the body portion in opposite directions and the first leg including a first contact portion and the second leg include a second contact portion, the body portion secured to the first housing, wherein the connector is configured, in operation, to mate with a first panel and a second panel and is further configured to couple a first set of two signal traces adjacent a first edge of the first panel with a second set of two signal traces adjacent a second edge of the second panel with the first and second contacts portions, wherein the contact portions are positioned in the notch so as to reduce capacitance at a point where the contact portions are configured to engage the corresponding signal trace.

2. The connector of claim 1, wherein the signal pair is a single-ended configuration.

3. The connector of claim 1, wherein the plurality of channels is a first plurality of channels and the two terminals are a first two terminals and wherein the second housing includes a second plurality of channels positioned on the third face and further includes a second two terminals positioned in the second plurality of channels.

4. The connector of claim 1, wherein the connector is configured to couple to the first panel having a first thickness and to the second panel having a second thickness, the second thickness greater than the first thickness.

5. The connector of claim 1, wherein the bodies of the two terminals are heat-staked to the first housing and the first and second legs are cantilevered from the bodies and are spaced apart from the first housing.

6. The connector of claim 1, wherein the signal pair is a differential signal pair configured to provide a data rate of at least 8 Gbps with a return loss performance of at least −15 db.

7. The connector of claim 6, wherein the differential signal pair is configured to provide a data rate of at least 15 Gbps with a return loss performance of at least −15 db.

8. The connector of claim 1, wherein the connector includes a first locking feature configured to mate with a first aperture in the first panel, wherein the connector, in operation, may be secured to the first panel.

9. The connector of claim 8, wherein the connector includes a second locking feature configured to mate with a second aperture in the second panel, wherein the connector, in operation, may be secured to the second panel.

10. The connector of claim 1, wherein the two terminals are a first differential signal pair, the connector further comprising at least a second differential signal pair electrically separated from the first signal pair, wherein both the first and the at least second differential signal pair are configured to provide a data rate of at least 15 Gbps between the first and second panel.

11. The connector of claim 10, wherein the electrical separation is provided with one of a ground terminal and a separation gap.

12. The connector of claim 10, wherein the connector is configure to provide at least 150 Gbps/(inch of panel edge) performance.

* * * * *